US012543813B2

(12) United States Patent
Durocher et al.

(10) Patent No.: US 12,543,813 B2
(45) Date of Patent: Feb. 10, 2026

(54) SYSTEMS AND METHODS FOR MOUNTING A FACEGUARD TO A HELMET

(71) Applicant: BAUER HOCKEY LLC, Exeter, NH (US)

(72) Inventors: Jacques Durocher, St-Jerome (CA); Marie-Claude Genereux, Sainte-Therese (CA); Charles-Antoine Desrochers, Mirabel (CA)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

(21) Appl. No.: 18/207,237

(22) Filed: Jun. 8, 2023

(65) Prior Publication Data

US 2023/0404201 A1 Dec. 21, 2023

Related U.S. Application Data

(60) Provisional application No. 63/352,684, filed on Jun. 16, 2022.

(51) Int. Cl.
*A42B 3/20* (2006.01)

(52) U.S. Cl.
CPC ..... *A42B 3/20* (2013.01)

(58) Field of Classification Search
CPC ..... A42B 3/20; A42B 3/04
See application file for complete search history.

(56) References Cited

U.S. PATENT DOCUMENTS 1,203,564 A * 11/1916 April ..... A42B 3/20 2/9
3,263,236 A * 8/1966 Humphrey ..... A42B 3/20 2/9
3,889,296 A * 6/1975 Martin ..... A42B 3/20 2/9
4,028,743 A * 6/1977 Christensen ..... A42B 3/20 2/9
4,220,301 A * 9/1980 Jacobs ..... A42B 3/20 2/9
4,363,140 A * 12/1982 Correale ..... A42B 3/20 2/9
4,370,759 A * 2/1983 Zide ..... A63B 71/10 2/9
4,587,677 A * 5/1986 Clement ..... A42B 3/20 24/458
4,594,737 A * 6/1986 Butash ..... A42B 3/20 2/9

(Continued)

FOREIGN PATENT DOCUMENTS

CA 3202632 A1 * 12/2023 ..... A42B 3/20

*Primary Examiner* — Khaled Annis

(57) ABSTRACT

A helmet for protecting a user's head, in which mounting of a faceguard to the helmet is facilitated, notably by clipping of the faceguard using a clip comprising openings to receive fasteners connecting the clip to the helmet, and a mount configured for placement of the faceguard thereon to mount the faceguard to the clip while the clip is connected to the fasteners. This may be useful for the user or other individuals, such as at a retail store or other location selling or otherwise providing the helmet and/or the faceguard and/or in various other situations and/or locations, including by allowing quick and convenient (e.g., toolless) mounting and/or removal of the faceguard to/from the helmet.

19 Claims, 21 Drawing Sheets

(56) References Cited

U.S. PATENT DOCUMENTS 4,692,947 A * 9/1987 Black ..... A42B 3/08 2/9
4,774,729 A * 10/1988 Coates ..... A42B 3/20 2/424
4,885,807 A * 12/1989 Snow, Jr. ..... A42B 3/20 2/424
5,409,323 A * 4/1995 Greene ..... F16B 37/0842 411/394
5,412,814 A * 5/1995 Pernicka ..... A42B 3/221 2/424
5,555,567 A * 9/1996 Corpus ..... A42B 3/20 2/9
5,978,973 A * 11/1999 Chartrand ..... A42B 3/20 2/424
6,199,219 B1 * 3/2001 Silken ..... A42B 3/20 24/458
6,301,719 B1 * 10/2001 Goodhand ..... A42B 3/20 24/324
6,722,711 B2 * 4/2004 Kitzis ..... B65F 1/1615 292/DIG. 31
8,146,178 B2 * 4/2012 Maddux ..... A42B 3/20 2/9
9,949,523 B2 * 4/2018 Klein ..... A42B 3/20
10,098,406 B2 * 10/2018 Erb ..... A42B 3/128
10,856,600 B2 * 12/2020 Ide ..... F16B 21/12
2010/0251464 A1 * 10/2010 Parisi ..... A42B 3/20 2/9
2011/0131710 A1 * 6/2011 Maddux ..... A42B 3/20 2/9
2011/0247181 A1 * 10/2011 Lin ..... A42B 3/20 24/455
2013/0025033 A1 * 1/2013 Durocher ..... A63B 71/10 2/417
2013/0333100 A1 * 12/2013 Erb ..... A42B 3/125 2/425
2014/0325744 A1 * 11/2014 Klein ..... A42B 3/20 267/136
2015/0335092 A1 * 11/2015 Erb ..... A42B 3/127 2/425
2016/0029733 A1 * 2/2016 Kovarik ..... A42B 3/20 2/424
2017/0056752 A1 * 3/2017 Tubbs ..... A42B 3/20
2017/0245575 A1 * 8/2017 Branch ..... A42B 3/20
2017/0311669 A1 * 11/2017 Morin ..... A42B 3/205
2018/0343953 A1 * 12/2018 Erb ..... A42B 3/064
2019/0037956 A1 * 2/2019 Dixon ..... A42B 3/20
2020/0375297 A1 * 12/2020 Cleveland ..... A63B 71/10
2021/0093036 A1 * 4/2021 Durocher ..... A42B 3/20
2021/0161241 A1 * 6/2021 Klein ..... A42B 3/20
2022/0047032 A1 * 2/2022 Handfield ..... A42B 3/04
2023/0404201 A1 * 12/2023 Durocher ..... A42B 3/20

* cited by examiner

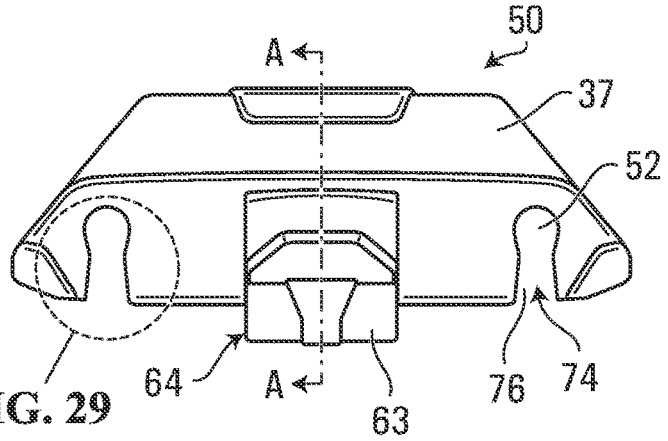
FIG. 29
FIG. 25
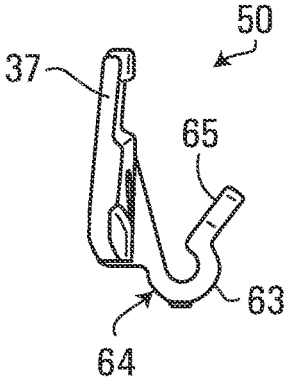
FIG. 26
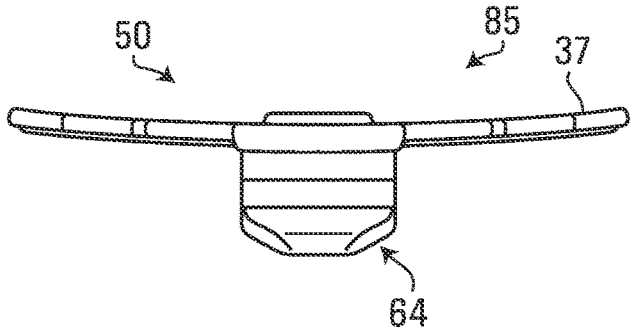
FIG. 27
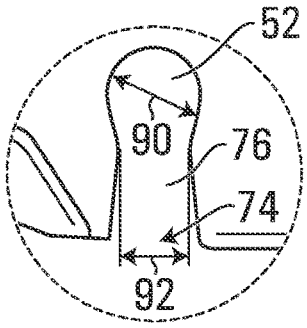
FIG. 29
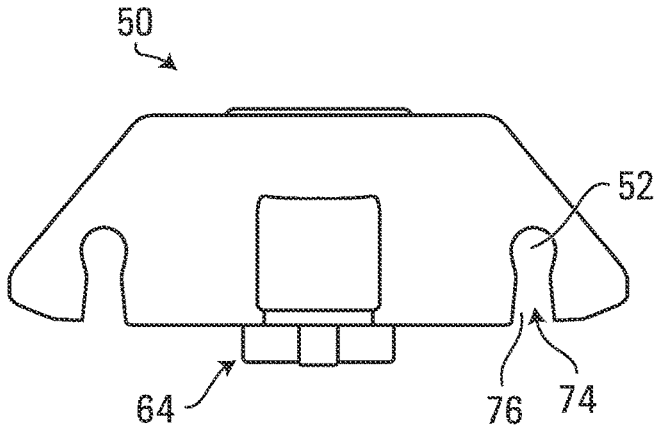
FIG. 28
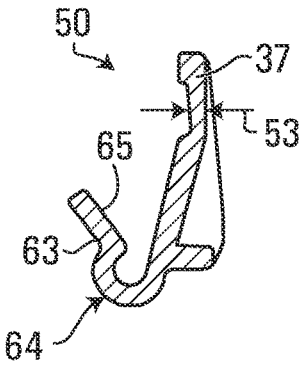
FIG. 30

SYSTEMS AND METHODS FOR MOUNTING A FACEGUARD TO A HELMET

CROSS-REFERENCE TO RELATED APPLICATIONS

This application claims the benefit of U.S. Provisional Patent Application Ser. No. 63/352,684, filed on Jun. 16, 2022. The contents of the aforementioned application are incorporated by reference herein.

FIELD

This disclosure relates generally to helmets (e.g., for playing hockey or other sports, etc.) and, more particularly, to helmets provided with faceguards (e.g., grids (a.k.a. "cages"), or visors).

BACKGROUND

Helmets are worn in sports (e.g., hockey) and other activities to protect their users against head injuries. To that end, helmets typically comprise a rigid outer shell and inner padding to absorb energy when impacted.

A helmet may be provided with a faceguard (e.g., a grid (a.k.a. "cage"), or visor) to protect at least part of a user's face, including his/her eyes. The faceguard may often be sold or otherwise provided separately from the helmet and then fastened to the helmet, such as at a retail store or other location selling or otherwise providing the helmet and/or the faceguard. This may sometimes be inefficient, impractical, and/or time-consuming, as different combinations of sizes may have to be tried out, tested and assembled for the user's head, fastening hardware has to be handled along with other components (e.g., to unfasten and re-fasten different faceguards), etc.

For these and other reasons, there is a need for improvements directed to facilitating provision of faceguards for helmets.

SUMMARY

According to various aspects, this disclosure relates to a helmet for protecting a user's head, in which mounting of a faceguard to the helmet is facilitated, notably by clipping of the faceguard. This may be useful for the user or other individuals, such as at a retail store or other location selling or otherwise providing the helmet and/or the faceguard and/or in various other situations and/or locations, including by allowing quick and convenient (e.g., toolless) mounting and/or removal of the faceguard to/from the helmet.

For example, according to one aspect, this disclosure relates to a clip for mounting a faceguard to a helmet. The clip comprises openings configured to receive fasteners connecting the clip to the helmet. The clip also comprises a mount configured to mount the faceguard to the clip. The clip is removable from the helmet to fasten the faceguard to the helmet with the fasteners.

According to another aspect, this disclosure relates to a clip for mounting a faceguard to a helmet. The clip comprises openings configured to receive fasteners connecting the clip to the helmet. The clip also comprises a mount configured to mount the faceguard to the clip. The clip is removable from the helmet while the fasteners are fastened to the helmet.

According to another aspect, this disclosure relates to a clip for mounting a faceguard to a helmet. The clip comprises openings configured to receive fasteners connecting the clip to the helmet. The clip also comprises a mount configured to mount the faceguard to the clip. The clip is removable from the helmet and the fasteners.

According to another aspect, this disclosure relates to a clip for mounting a faceguard to a helmet. The clip comprises openings configured to receive fasteners connecting the clip to the helmet. The clip also comprises a mount configured to mount the faceguard to the clip. The clip is removable from the helmet by moving the clip upwardly relative to the helmet.

According to another aspect, this disclosure relates to a clip for mounting a faceguard to a helmet. The clip comprises openings configured to receive fasteners connecting the clip to the helmet. The clip also comprises a hook configured to mount the faceguard to the clip by suspending the faceguard from the hook.

According to another aspect, this disclosure relates to a clip for mounting a faceguard to a helmet. The clip comprises a base configured to be connected to the helmet. The clip also comprises a lock manually movable relative to the base between an open position in which the clip allows the faceguard to be received by the clip and removed from the clip and a closed position in which the clip precludes the faceguard from being received by the clip and removed from the clip.

According to another aspect, this disclosure relates to a helmet for protecting a user's head. The helmet comprises a shell, padding disposed within the shell and a clip for mounting a faceguard to the helmet. The clip comprises openings configured to receive fasteners connecting the clip to the helmet. The clip also comprises a mount configured to mount the faceguard to the clip. The clip is removable from the helmet to fasten the faceguard to the helmet with the fasteners.

According to another aspect, this disclosure relates to a helmet for protecting a user's head. The helmet comprises a shell, padding disposed within the shell and a clip for mounting a faceguard to the helmet. The clip comprises openings configured to receive fasteners connecting the clip to the helmet. The clip also comprises a mount configured to mount the faceguard to the clip. The clip is removable from the helmet while the fasteners are fastened to the helmet.

According to another aspect, this disclosure relates to a helmet for protecting a user's head. The helmet comprises a shell, padding disposed within the shell and a clip for mounting a faceguard to the helmet. The clip comprises openings configured to receive fasteners connecting the clip to the helmet. The clip also comprises a mount configured to mount the faceguard to the clip. The clip is removable from the helmet by sliding the clip relative to the helmet and the fasteners.

According to another aspect, this disclosure relates to a helmet for protecting a user's head. The helmet comprises a shell, padding disposed within the shell and a clip for mounting a faceguard to the helmet. The clip comprises openings configured to receive fasteners connecting the clip to the helmet. The clip also comprises a mount configured to mount the faceguard to the clip. The clip is removable from the helmet by moving the clip upwardly relative to the helmet.

According to another aspect, this disclosure relates to a helmet for protecting a user's head. The helmet comprises a shell, padding disposed within the shell and a clip for mounting a faceguard to the helmet. The clip comprises openings configured to receive fasteners connecting the clip to the helmet. The clip also comprises a hook configured to mount the faceguard to the clip by suspending the faceguard from the hook.

According to another aspect, this disclosure relates to a helmet for protecting a user's head. The helmet comprises a shell, padding disposed within the shell and a clip for mounting a faceguard to the helmet. The clip comprises a base configured to be connected to the helmet. The clip also comprises a lock manually movable relative to the base between an open position in which the clip allows the faceguard to be received by the clip and removed from the clip and a closed position in which the clip precludes the faceguard from being received by the clip and removed from the clip.

According to another aspect, this disclosure relates to a method of facilitating mounting of a faceguard to a helmet. The method comprises providing a clip configured to mount the faceguard to the helmet. The clip comprises openings configured to receive fasteners connecting the clip to the helmet. The clip also comprises a mount configured to mount the faceguard to the clip. The method also comprises connecting the clip to the helmet. The method further comprises allowing removal of the clip from the helmet to fasten the faceguard to the helmet with the fasteners.

According to another aspect, this disclosure relates to a method of fastening a faceguard to a helmet. The helmet comprises a clip mounting the faceguard to the helmet. The clip comprises openings configured to receive fasteners connecting the clip to the helmet. The method comprises removing the faceguard from the clip. The method also comprises removing the clip from the helmet. The method further comprises fastening the faceguard to the helmet with the fasteners.

These and other aspects of this disclosure will now become apparent to those of ordinary skill upon review of a description of embodiments that follows in conjunction with accompanying drawings.

BRIEF DESCRIPTION OF DRAWINGS

A detailed description of embodiments is provided below, by way of example only, with reference to drawings accompanying this description, in which:

FIG. 25 is a front view of the clip;

FIG. 26 is a side view of the clip;

FIG. 27 is a top view of the clip;

FIG. 28 is a rear view of the clip;

FIG. 29 is an enlarged view of an opening of the clip;

FIG. 30 is a cross-sectional view of FIG. 25 of the clip;

Figure 1:
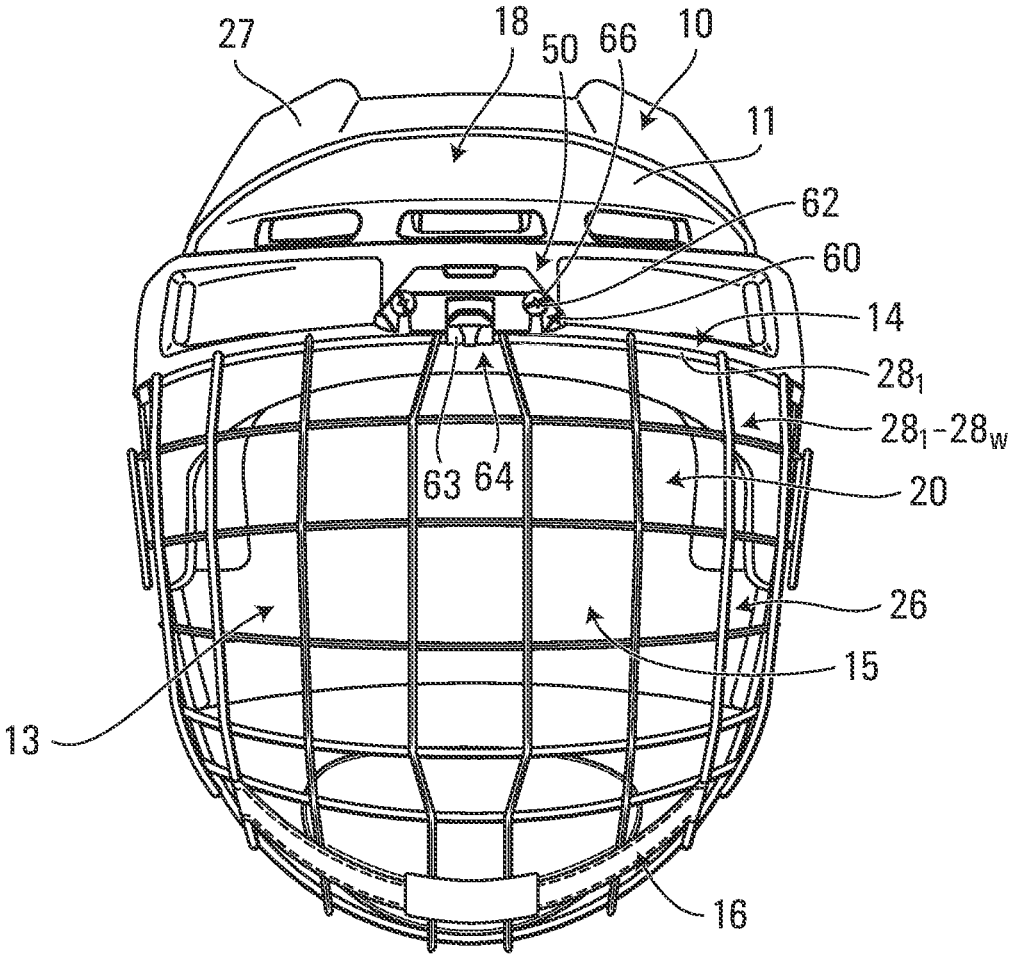
FIG. 1 shows an embodiment of a helmet for protecting a user's head, in which the helmet is provided with a faceguard and a clip is provided to mount the faceguard to the helmet.
Figure 2:
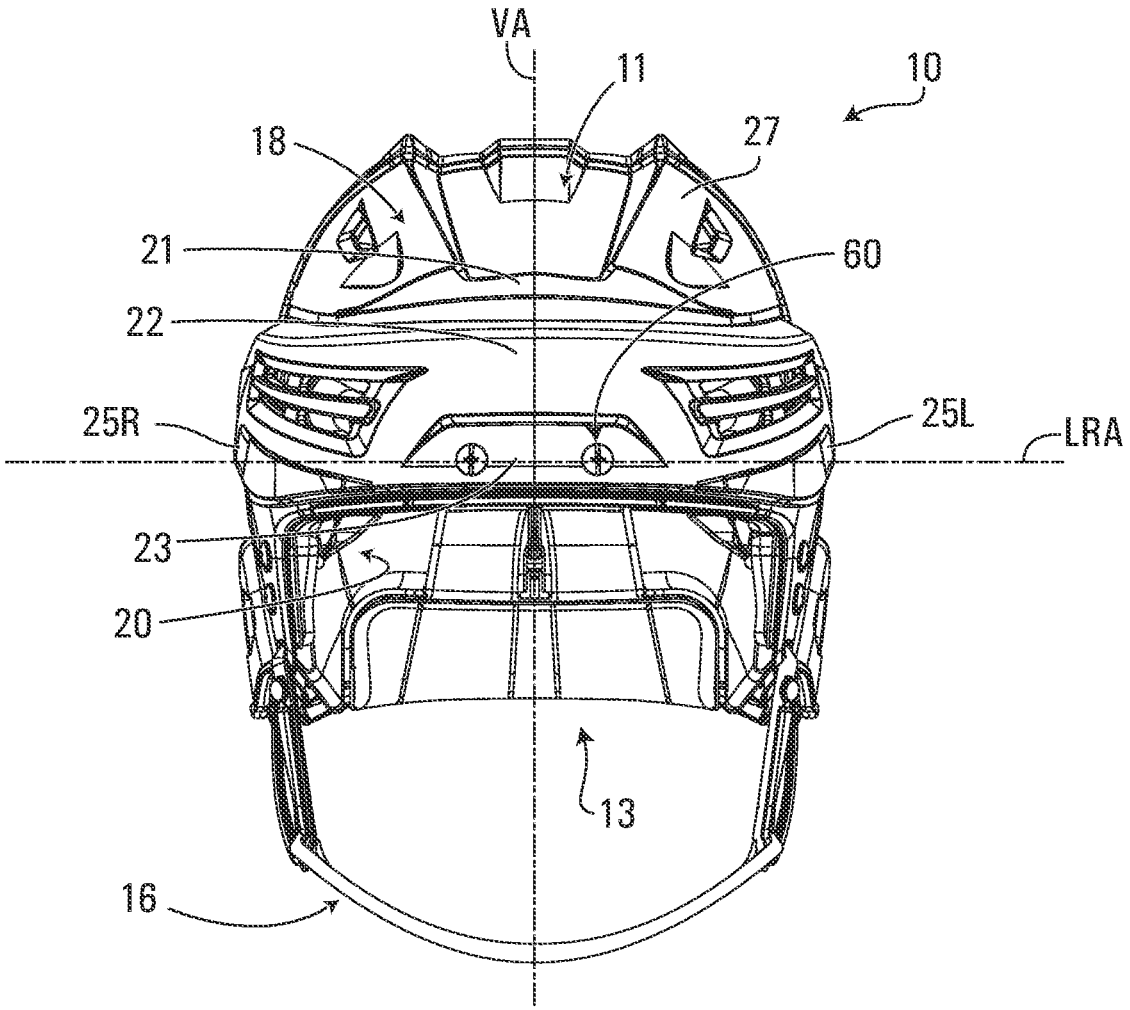
FIG. 2 shows a front view of the helmet.
Figure 3:
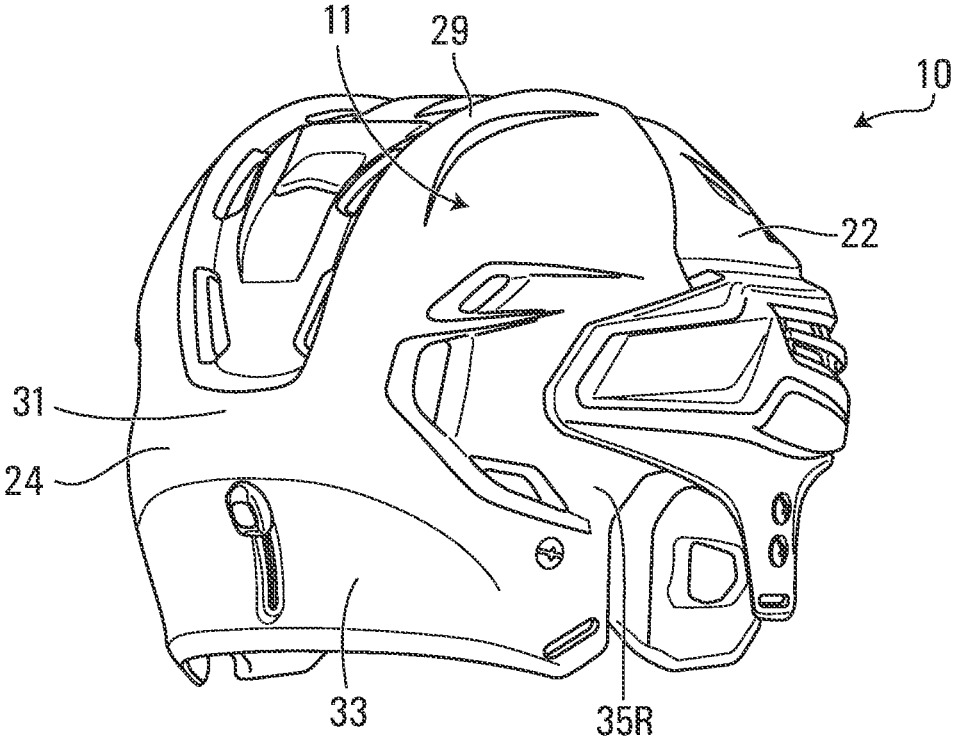
FIGS. 3 and 4 show rear perspective views of the helmet.
Figure 4:
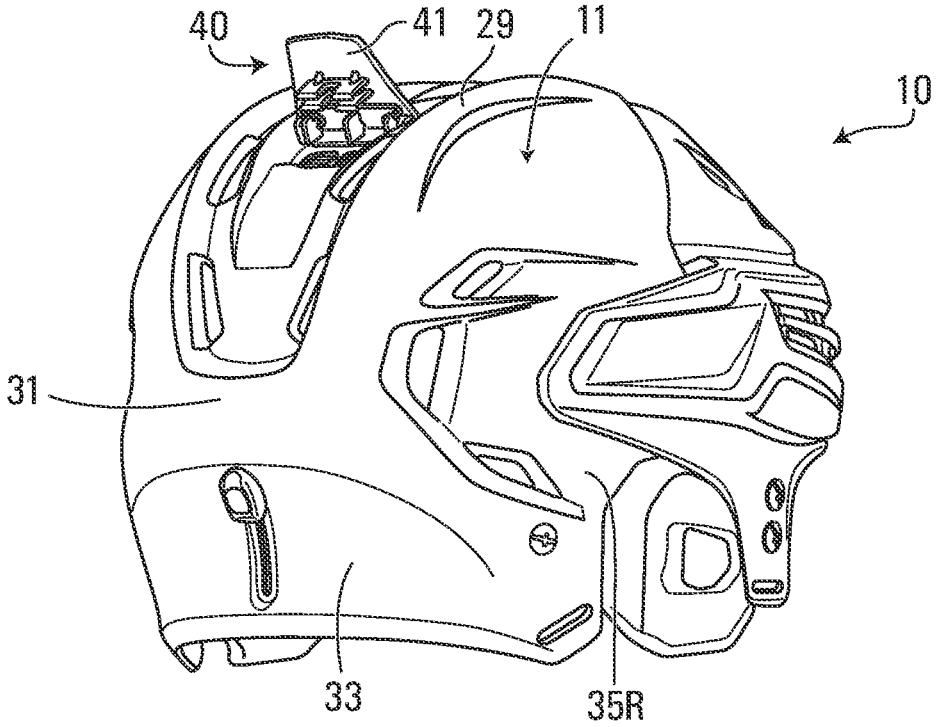

It is to be expressly understood that the description and drawings are only for purposes of illustrating certain embodiments and are an aid for understanding. They are not intended to be and should not be limiting.

DETAILED DESCRIPTION OF EMBODIMENTS

FIGS. 1 to 18 show an embodiment of a helmet 10 for protecting a user's head, in which the helmet 10 is provided with a faceguard 14. In this embodiment, the helmet 10 is an athletic helmet for protecting the head of the user who is engaging in a sport or other athletic activity against impacts. More particularly, in this embodiment, the helmet 10 is a hockey helmet for protecting the head of the user, who is a hockey player, against impacts (e.g., from a puck or ball, a hockey stick, a board, ice or another playing surface, etc., with another player, etc.).

As further discussed below, in this embodiment, mounting of the faceguard 14 to the helmet 10 is facilitated, notably by clipping of the faceguard 14. This may be useful for the user or other individuals, such as at a retail store or other location selling or otherwise providing the helmet 10 and/or the faceguard 14 and/or in various other situations and/or locations, including by allowing quick and convenient (e.g., toolless) mounting and/or removal of the faceguard 14 to/from the helmet 14.

The helmet 10 comprises an outer shell 11 and a liner 15 to protect the user's head. In this example, the helmet 10 also comprises a chinstrap 16 for securing the helmet 10 to the user's head. The helmet 10 comprises a clip 50 for mounting the faceguard 14 to the helmet 10.

Figure 20:
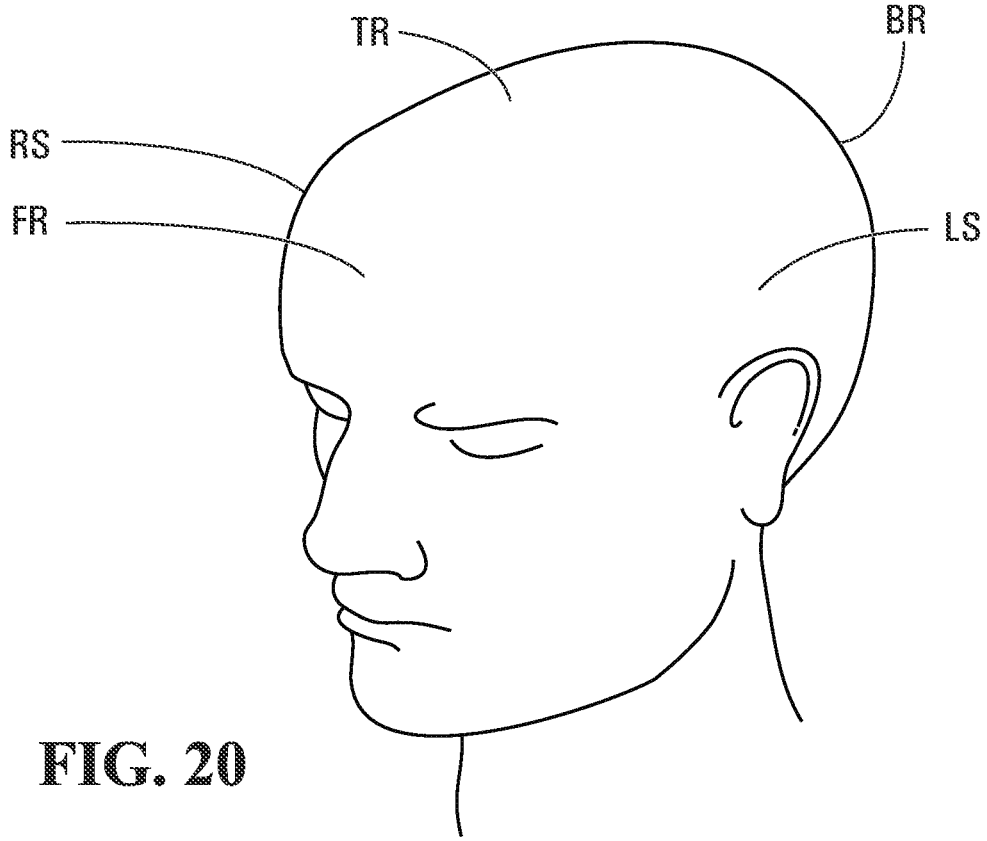
FIGS. 20 and 21 show a head of a user.
Figure 21:
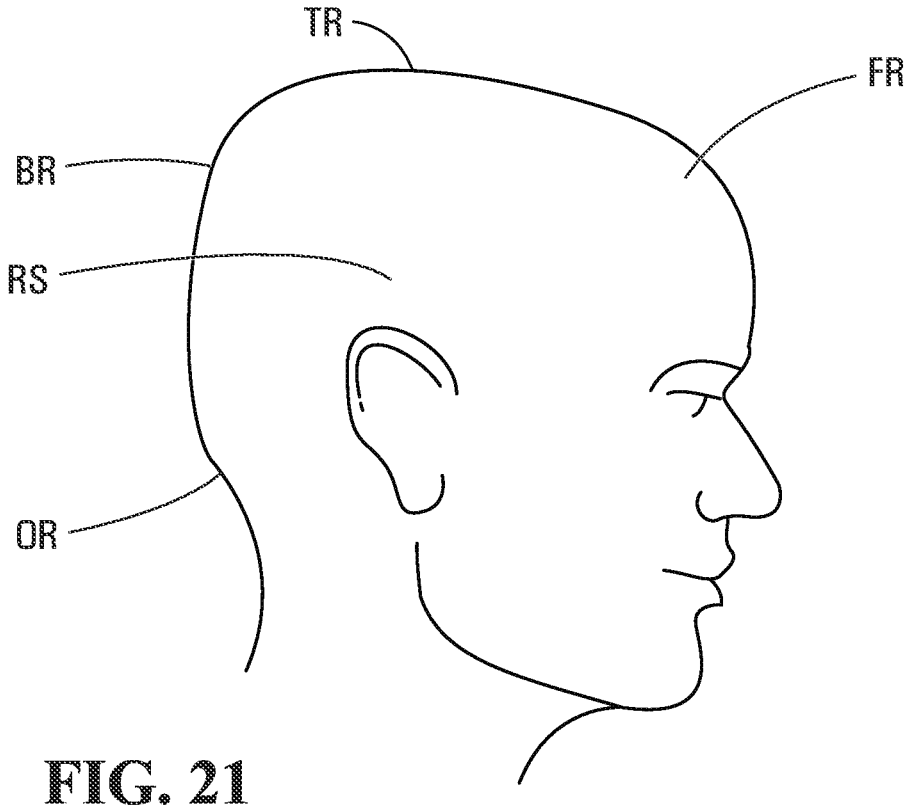

A cavity 13 of the helmet 10 is configured to receive the user's head. In response to an impact, the helmet 10 absorbs energy from the impact to protect the user's head. The helmet 10 protects various regions of the user's head. As shown in FIGS. 20 and 21, the user's head comprises a front region FR, a top region TR, left and right side regions LS, RS, a back region BR, and an occipital region OR. The front region FR includes a forehead and a front top part of the user's head and generally corresponds to a frontal bone region of the user's head. The left and right side regions LS, RS are approximately located above the user's ears. The back region BR is opposite the front region FR and includes a rear upper part of the user's head. The occipital region OR substantially corresponds to a region around and under the head's occipital protuberance.

The helmet 10 comprises an external surface 18 and an internal surface 20 that contacts the user's head when the helmet 10 is worn. The helmet 10 has a front-back axis FBA, a left-right axis LRA, and a vertical axis VA which are respectively generally parallel to a dorsoventral axis, a dextrosinistral axis, and a cephalocaudal axis of the user when the helmet 10 is worn and which respectively define a front-back direction, a lateral direction, and a vertical direction of the helmet 10. Since they are generally oriented longitudinally and transversally of the helmet 10, the front-back axis FBA and the left-right axis LRA can also be referred to as a longitudinal axis and a transversal axis, respectively, while the front-back direction and the lateral direction can also be referred to a longitudinal direction and a transversal direction, respectfully.

The outer shell 11 provides strength and rigidity to the helmet 10. To that end, the outer shell 11 typically comprises a rigid material 27. For example, in various embodiments, the rigid material 27 of the outer shell 11 may be a thermoplastic material such as polyethylene (PE), polyamide (nylon), or polycarbonate, a thermosetting resin, or any other suitable material. The outer shell 11 includes an inner surface 17 facing the inner liner 15 and an outer surface 19 opposite the inner surface 17. The outer surface 19 of the outer shell 11 constitutes at least part of the external surface 18 of the helmet 10.

In this embodiment, the outer shell 11 comprises shell members 22, 24 that are connected to one another. In this example, the shell member 22 comprises a top portion 21 for facing at least part of the top region TR of the user's head, a front portion 23 for facing at least part of the front region FR of the user's head, and left and right lateral side portions 25L, 25R extending rearwardly from the front portion 23 for facing at least part of the left and right side regions LS, RS of the user's head, respectively. The shell member 24 comprises a top portion 29 for facing at least part of the top region TR of the user's head, a back portion 31 for facing at least part of the back region BR of the user's head, an occipital portion 33 for facing at least part of the occipital region OR of the user's head, and left and right lateral side portions 35L, 35R extending forwardly from the back portion 31 for facing at least part of the left and right side regions LS, RS of the user's head, respectively.

Figure 22:
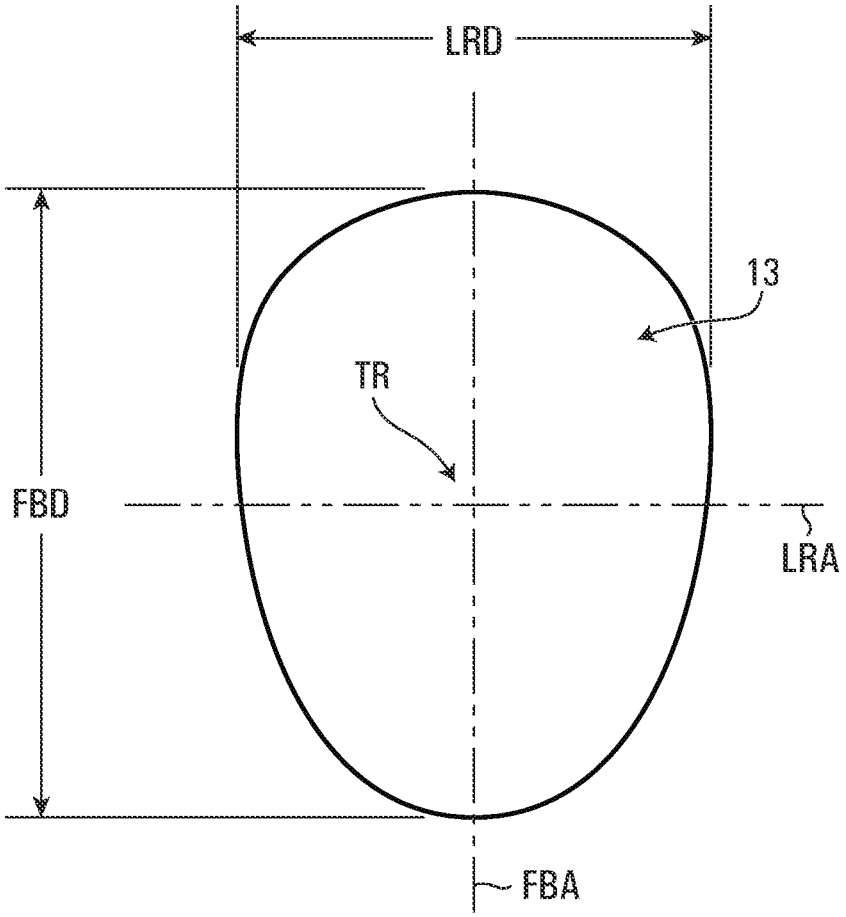
FIG. 22 shows internal dimensions of a head-receiving cavity of the helmet.

In this embodiment, the helmet 10 is adjustable to adjust how it fits on the user's head. To that end, the helmet 10 comprises an adjustment mechanism 40 for adjusting a fit of the helmet 10 on the user's head. The adjustment mechanism 40 may allow the fit of the helmet 10 to be adjusted by adjusting one or more internal dimensions of the cavity 13 of the helmet 10, such as a front-back internal dimension FBD of the cavity 13 in the front-back direction of the helmet 10 and/or a left-right internal dimension LRD of the cavity 13 in the left-right direction of the helmet 10, as shown in FIG. 22.

Figure 5:
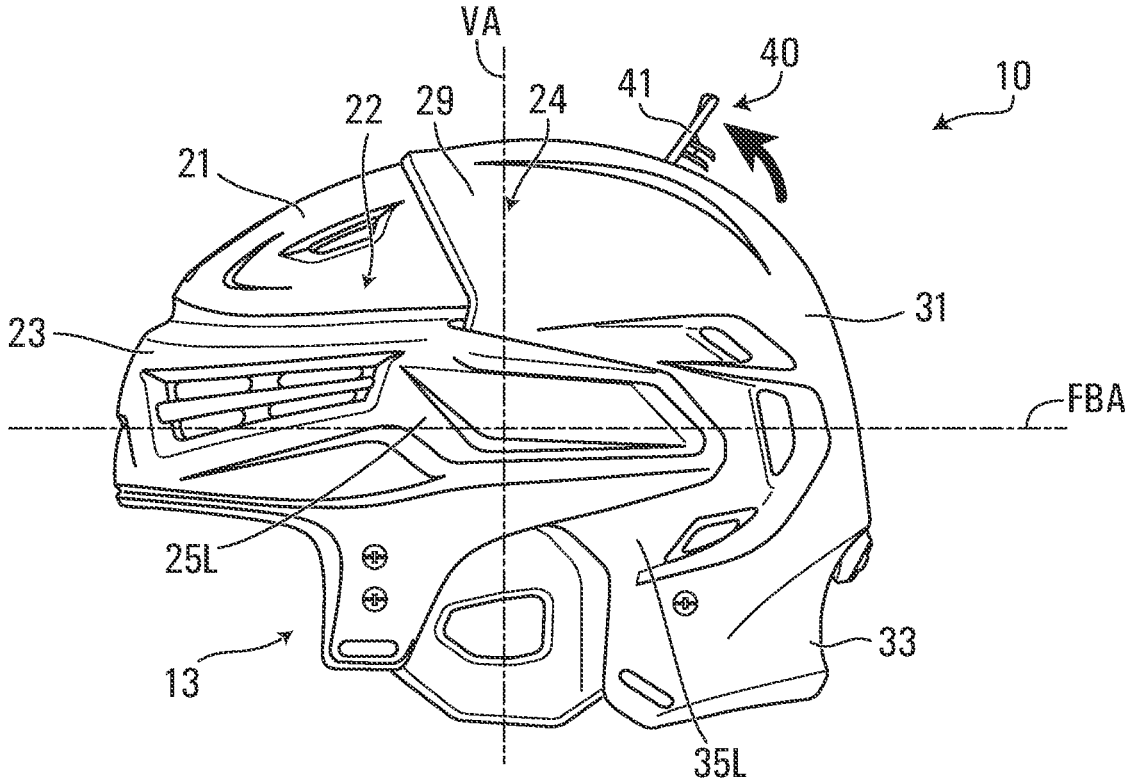
FIGS. 5 to 8 show an adjustment mechanism of the helmet.
Figure 6:
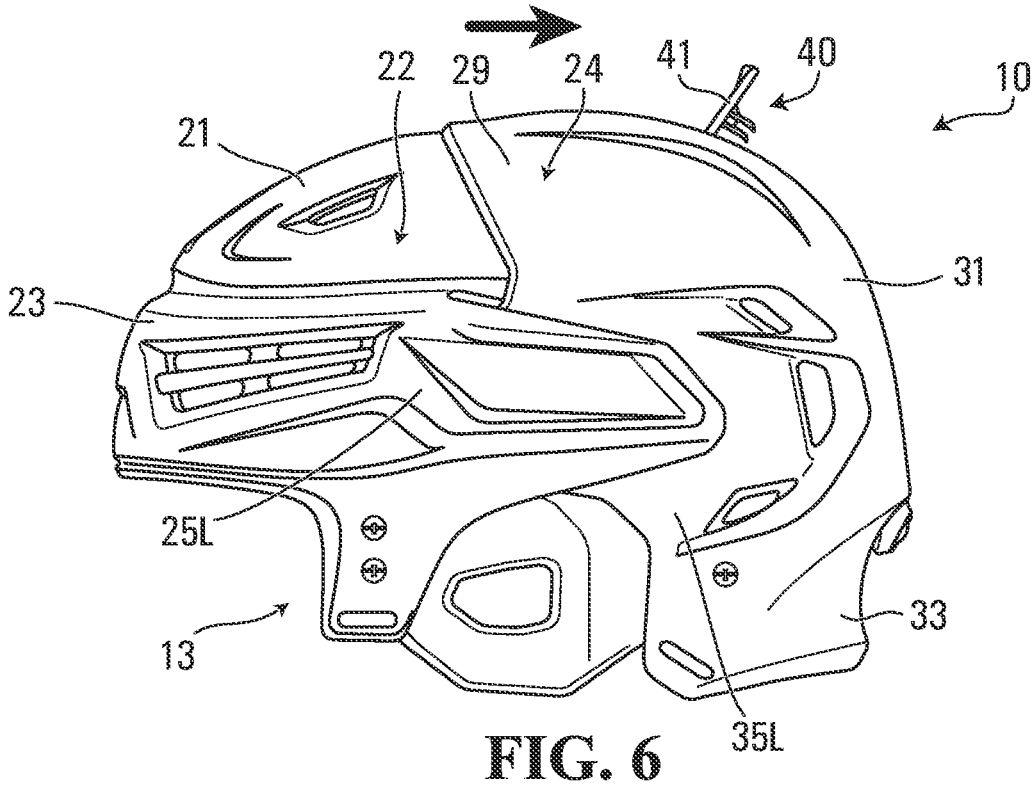
Figure 7:
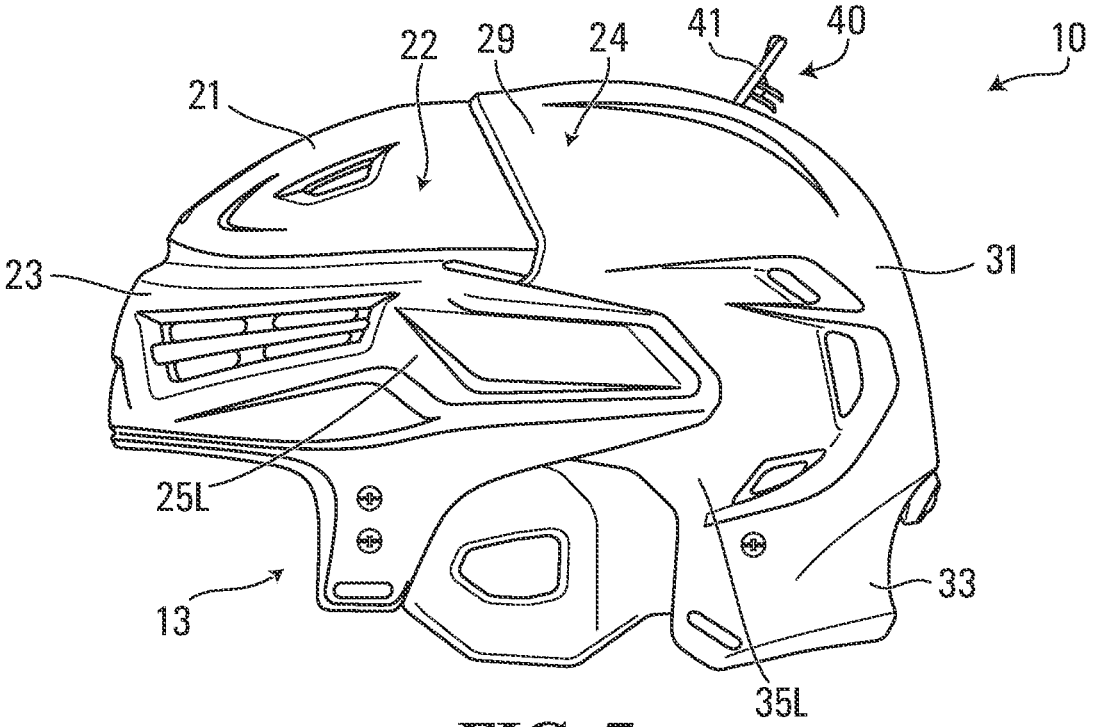
Figure 8:
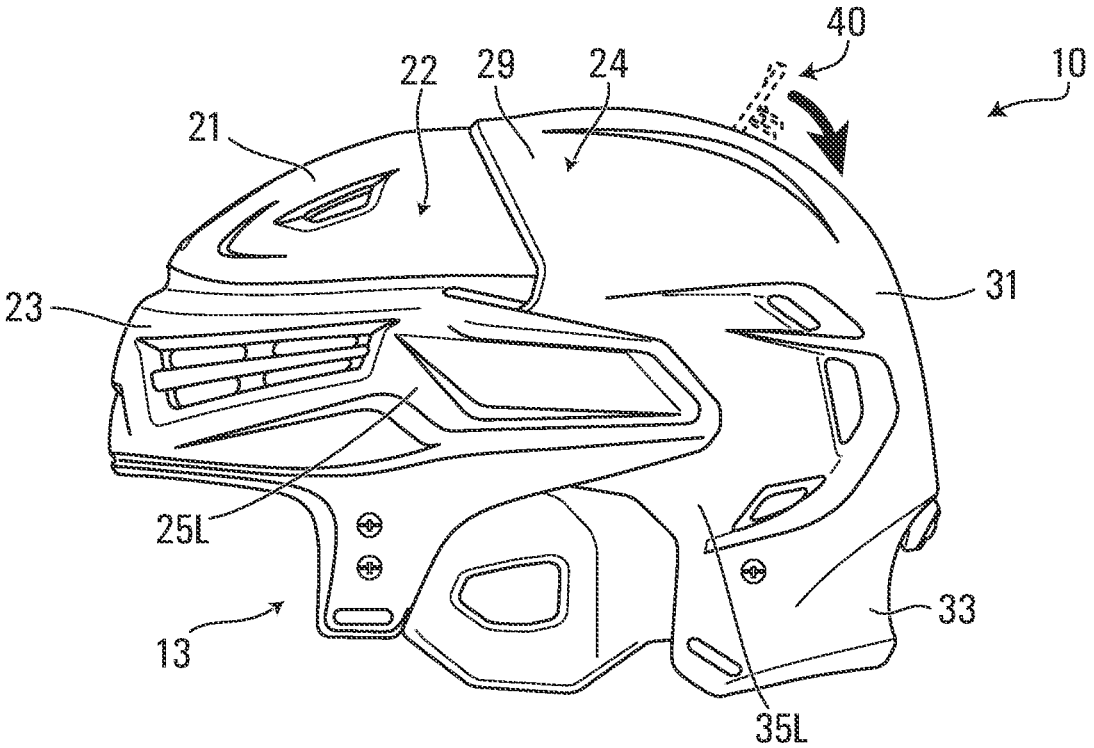

More particularly, in this embodiment, the adjustment mechanism 40 is configured such that the outer shell 11 and the liner 15 are adjustable to adjust the fit of the helmet 10 on the user's head. To that end, in this embodiment, the shell members 22, 24 are movable relative to one another to adjust the fit of the helmet 10 on the user's head. In this example, relative movement of the shell members 22, 24 for adjustment purposes is in the front-back direction of the helmet 10 such that the front-back internal dimension FBD of the cavity 13 of the helmet 10 is adjusted. This is shown in FIGS. 5 to 8 in which the shell member 24 is moved relative to the shell member 22 from a first position, which is shown in FIG. 5 and which corresponds to a minimum size of the helmet 10, to a second position, which is shown in FIG. 6 and which corresponds to an intermediate size of the helmet 10, and to a third position, which is shown in FIGS. 7 and 8 which corresponds to a maximum size of the helmet 10.

Figure 9:
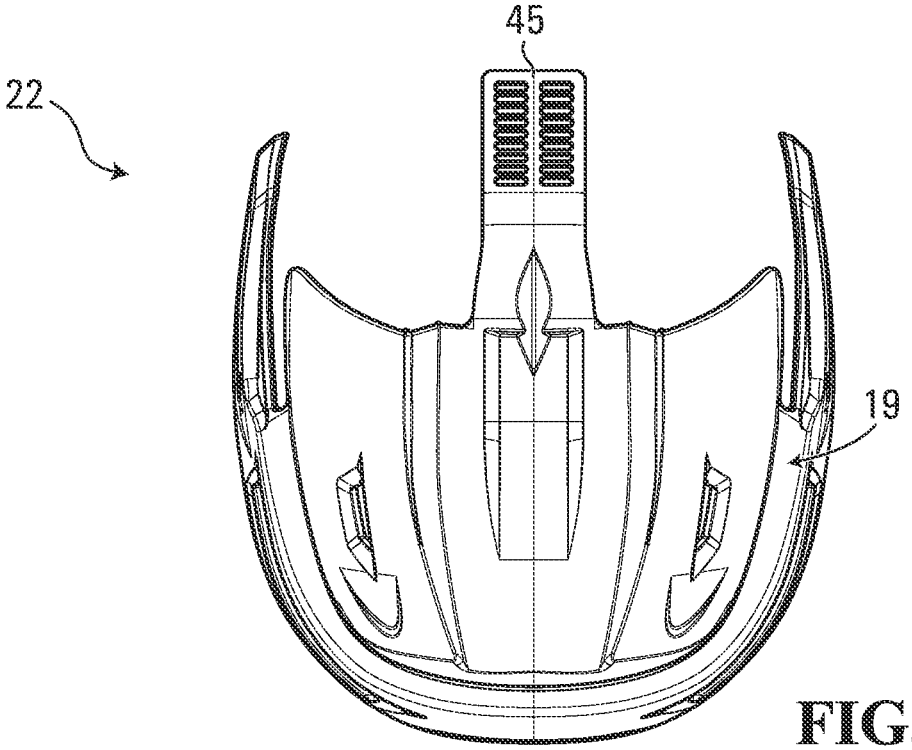
FIGS. 9 and 10 show an example of shell members of an outer shell of the helmet.
Figure 10:
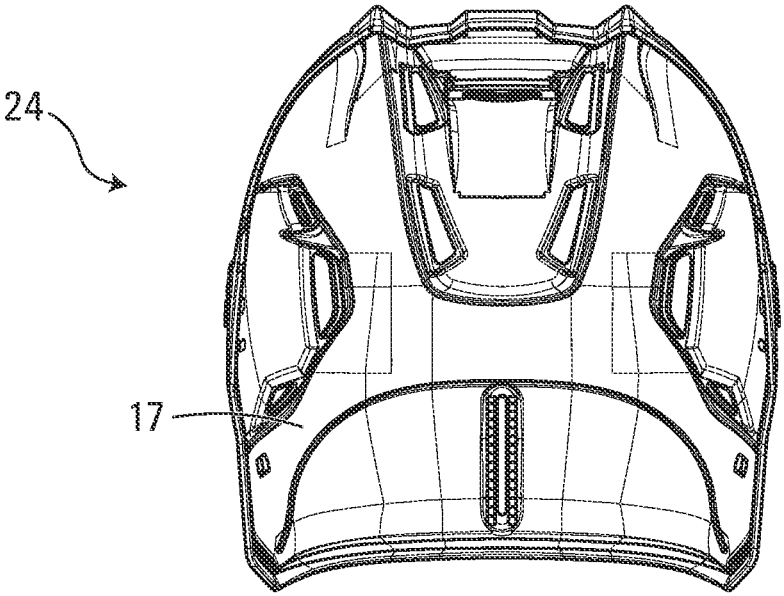
Figure 11:
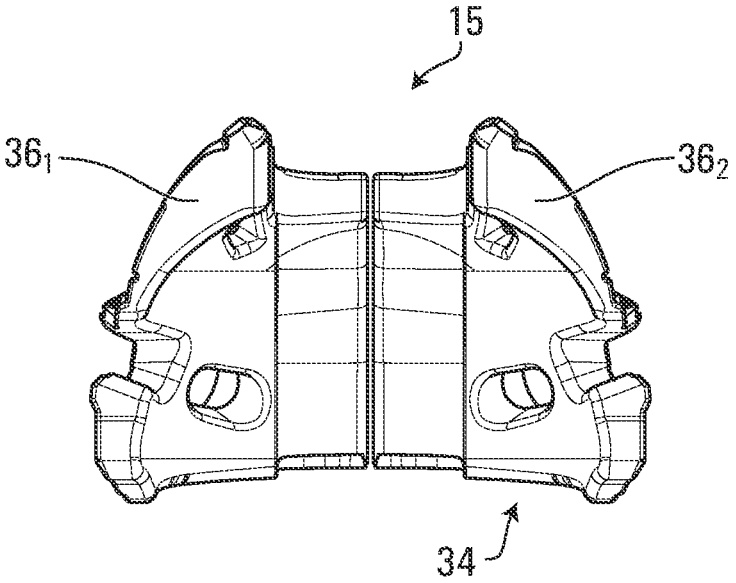
FIGS. 11 to 14 show pads of a liner of the helmet.
Figure 12:
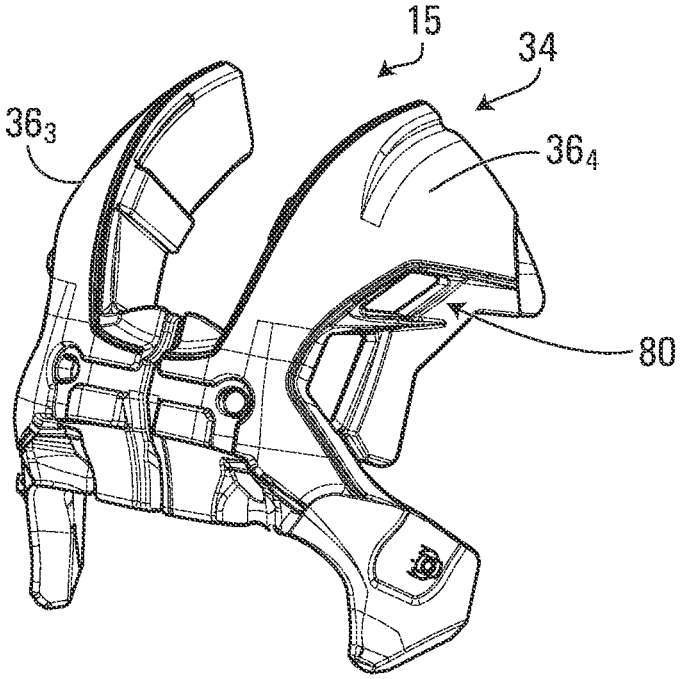
Figure 13:
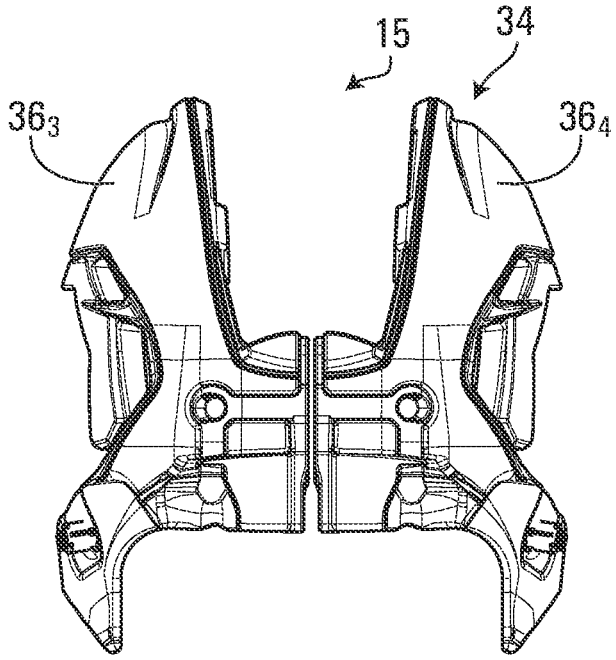
Figure 14:
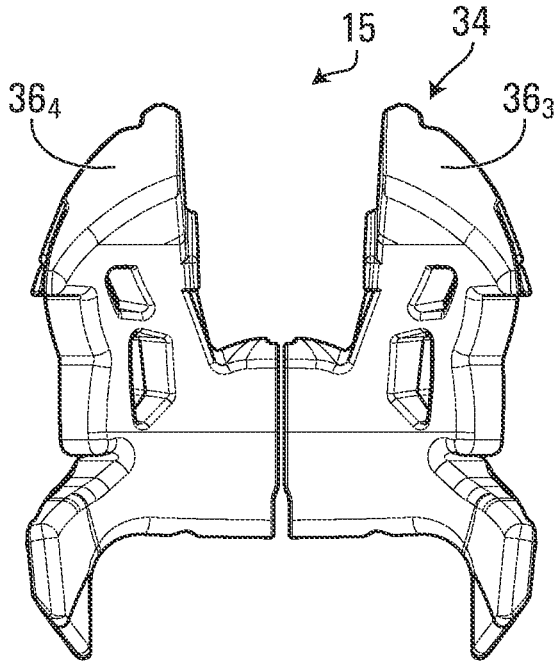

In this example of implementation, the adjustment mechanism 40 comprises an actuator 41 that can be moved (in this case pivoted) by the user between a locked position, in which the actuator 41 engages a locking part 45 (as best shown in FIGS. 9 and 10) of the shell member 22 and thereby locks the shell members 22, 24 relative to one another, and a release position, in which the actuator 41 is disengaged from the locking part 45 of the shell member 22 and thereby permits the shell members 22, 24 to move relative to one another so as to adjust the size of the helmet 10. The adjustment mechanism 40 may be implemented in any other suitably way in other embodiments.

The liner 15 is disposed within the outer shell 11, i.e., between the outer shell 11 and the user's head when the helmet 10 is worn. More particularly, the liner 15 comprises shock-absorbing material. For instance, in some cases, the shock-absorbing material may include a polymeric foam (e.g., expanded polypropylene (EPP) foam, expanded polyethylene (EPE) foam, expanded polymeric microspheres (e.g., Expancel™ microspheres commercialized by Nouryon), or any other suitable polymeric foam material) and/or a polymeric structure comprising one or more polymeric materials. Any other material with suitable impact energy absorption may be used in other embodiments. Additionally or alternatively, in some embodiments, the liner 15 may comprise an array of shock absorbers that are configured to deform when the helmet 10 is impacted. For instance, in some cases, the array of shock absorbers may include an array of compressible cells that can compress when the helmet 10 is impacted. Examples of this are described in U.S. Pat. No. 7,677,538 and U.S. Patent Application Publication 2010/0258988, which are incorporated by reference herein.

The liner 15 may be connected to the outer shell 11 in any suitable way. For example, in some embodiments, the inner liner 15 may be fastened to the outer shell 11 by one or more fasteners such as mechanical fasteners (e.g., tacks, staples, rivets, screws, stitches, etc.), an adhesive, or any other suitable fastener.

In this embodiment, the liner 15 comprises padding 34. In this example, the padding 34 comprises a plurality of pads 361-36A disposed between the outer shell 11 and the user's head when the helmet 10 is worn. In this example, respective ones of the pads 361-36A are movable relative to one another and with the shell members 22, 24 to allow adjustment of the fit of the helmet 10 using the adjustment mechanism 40.

More particularly, in this embodiment, the pad 361 is for facing at least part of the front region FR and left side region LS of the user's head, the pad 362 is for facing at least part of the front region FR and right side region RS of the user's head, the pad 363 is for facing at least part of the back region BR and left side region LS of the user's head, the pad 364 is for facing at least part of the back region BR and right side region RS of the user's head. Another pad, (not shown in FIGS. 11 to 14) is for facing at least part of the top region TR and back region BR of the user's head. The shell member 22 overlays the pads 361, 362 while the shell member 24 overlays the pads 363, 364.

In this example, respective ones of the pads 361-36A are responsible for absorbing at least a bulk of the impact energy transmitted to the inner liner 15 when the helmet 10 is impacted and can therefore be referred to as "absorption" pads, while other ones of the pads 361-36A are responsible to provide comfort to the user's head and can therefore be referred to as "comfort" pads. In some cases, one or more of these comfort pads may be secured (e.g., adhered, fastened, etc.) to these absorption pads. In other cases, one or more of these comfort pads may be mounted such that they are movable relative to one or more of these absorption pads. For example, in some embodiments, one or more of these comfort pads may be part of a floating liner as described in U.S. Patent Application Publication 2013/0025032. These comfort pads may assist in absorption of energy from impacts, in particular, low-energy impacts.

The faceguard 14 is configured to protect at least part of the user's face, including eyes of the user. That is, the faceguard 14 may protect an entirety of the user's face, in which case it may be referred to as providing "full-face" protection, or may protect less than the entirety (e.g., half or some other fraction) of the user's face, in which case it may be referred to as providing "half-face" or "partial-face" protection.

In this embodiment, the faceguard 14 comprises a grid 26, sometimes referred to as a "cage", which includes a plurality of wires $\mathbf{28}_1$-$\mathbf{28}_W$ intersecting one another. The wires $\mathbf{28}_1$-$\mathbf{28}_W$ may be metallic (e.g., made of steel, titanium and/or other suitable metal). Respective ones of the wires $\mathbf{28}_1$-$\mathbf{28}_W$ may be connected to one another by welding, by integrally forming (e.g., casting, additively-manufacturing, etc.) them together, and/or by any other means.

The clip 50 is configured to mount the faceguard 14 to the helmet 10. For example, in some embodiments, this may be useful at a retail store or other location where the helmet and the faceguard 14 are sold, and/or in various other situations and/or locations (e.g., where hockey is played).

In this embodiment, the clip 50 comprises openings 52 configured to receive fasteners 60 connecting the 50 clip to the helmet 10 and a mount 64 configured to mount the faceguard 14 to the helmet 10.

Figure 16:
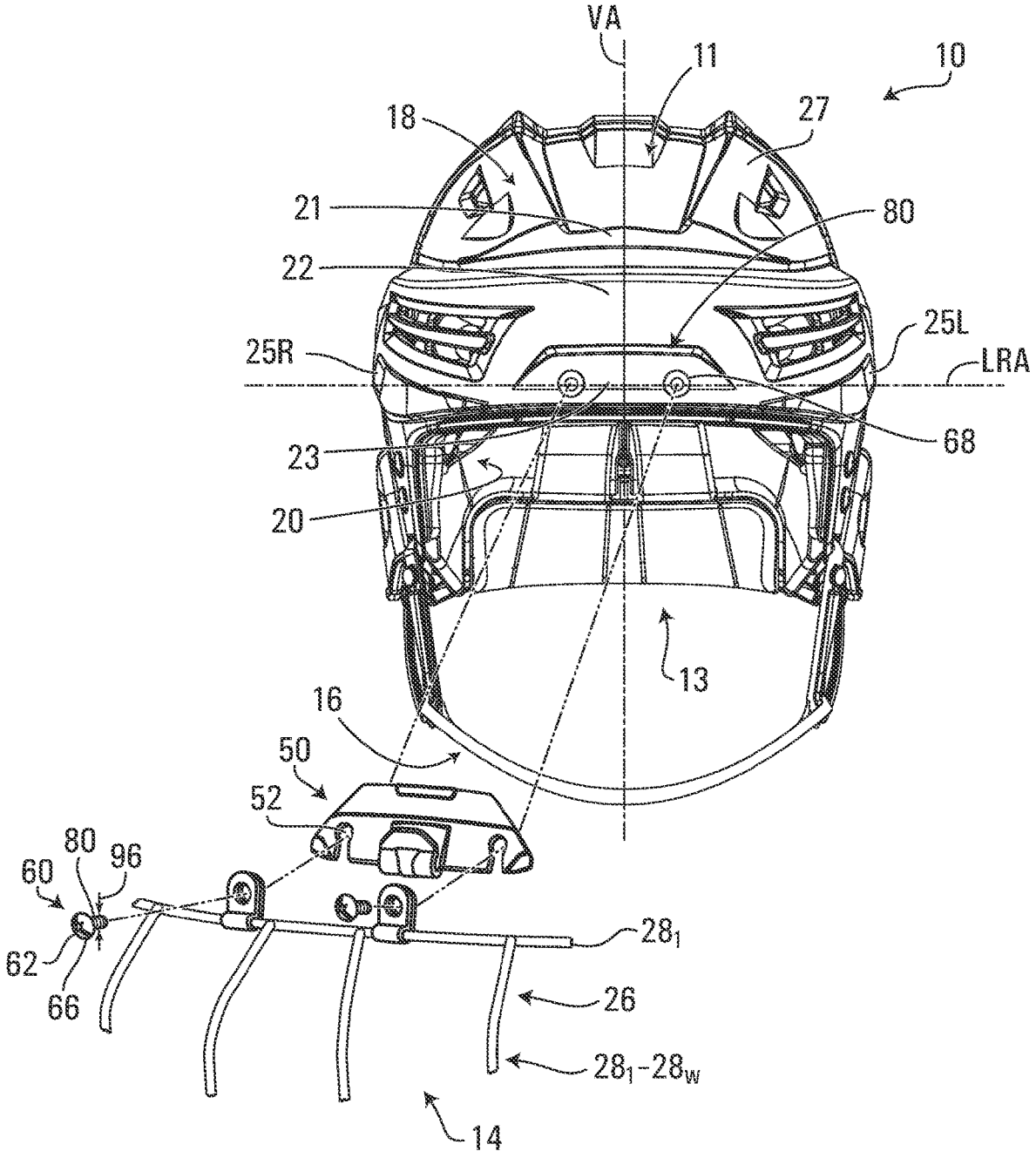
FIG. 16 shows an exploded view of the clip, the faceguard, and fasteners configured to fasten the faceguard to the helmet.

The clip 50 is removable from the helmet 10 to fasten the faceguard 14 to the helmet 10 with the fasteners 60. More particularly, in this embodiment, the helmet 10 comprises holes 68 configured to receive the fasteners 60 such that the fasteners 60 fasten the faceguard 14 to the helmet 10 when the clip 50 is removed from the helmet 10, and the openings 52 of the clip 50 are configured to be aligned with the holes 68 of the helmet 10, as shown in FIG. 16. In some embodiments, the holes 68 may extend entirely through the outer shell 11 of the helmet 10. In other embodiments, the holes 68 may only extend partially through the outer shell 11 of the helmet 10.

Figure 15:
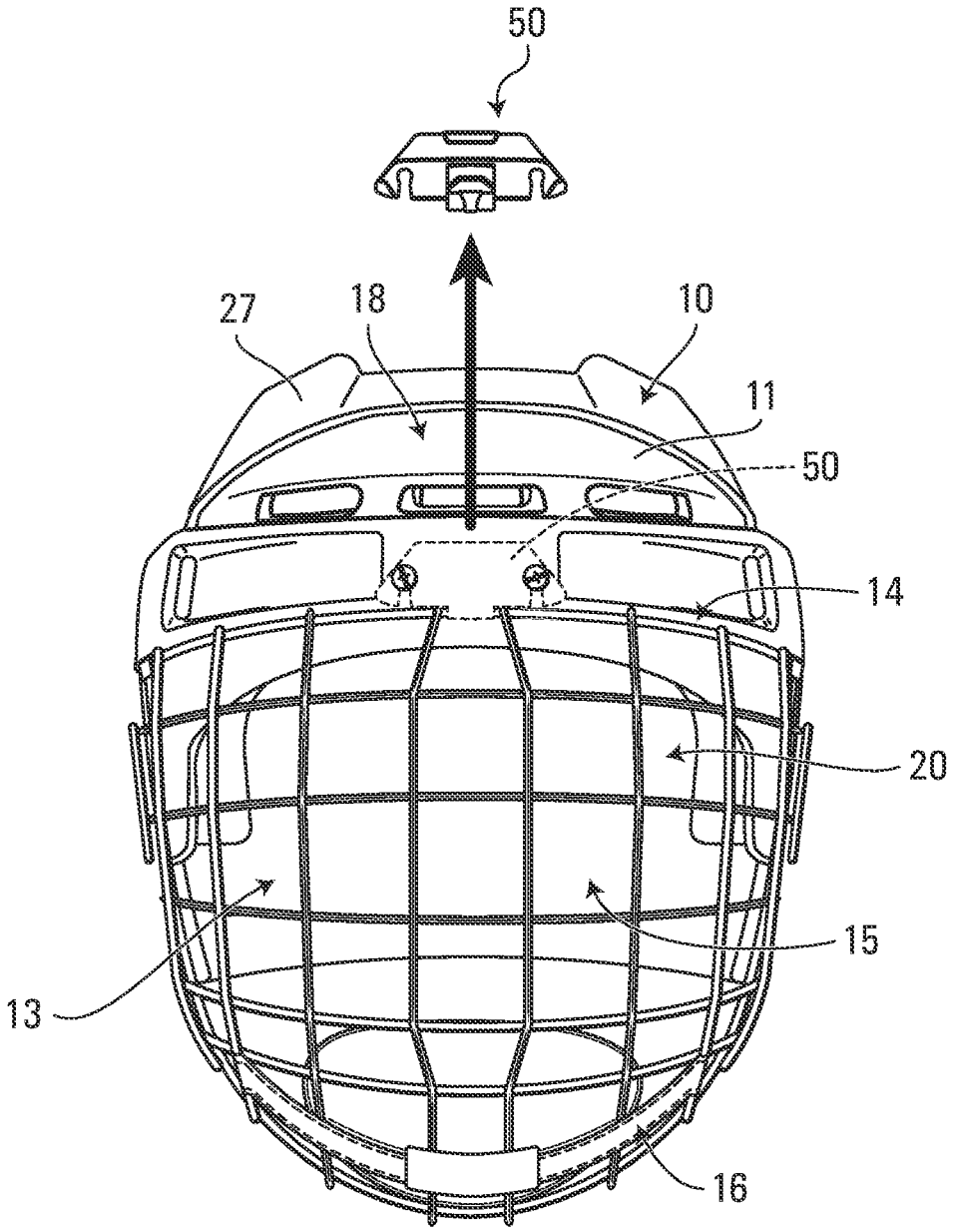
FIG. 15 shows the clip removed from the helmet.

In this embodiment, the clip 50 is removable from the helmet 10 while the fasteners 60 are fastened to the helmet 10, as shown in FIG. 15. In this example, the clip 50 is removable from the helmet 10 without removing the fasteners 60 from the helmet 10.

Thus, the clip 50 is removable from the helmet 10 while the fasteners 60 are fastened to the helmet 10.

In this case, the clip 50 is removable from the helmet 10 by sliding the clip 50 relative to the helmet 10 and the fasteners 60. With further reference to FIG. 15, in this example, the clip 50 is removable from the helmet 10 by moving the clip 50 upwardly relative to the helmet 10 (i.e., by moving the clip 50 upwardly from an initial position as denoted by the dotted lines in FIG. 15).

Figure 24:
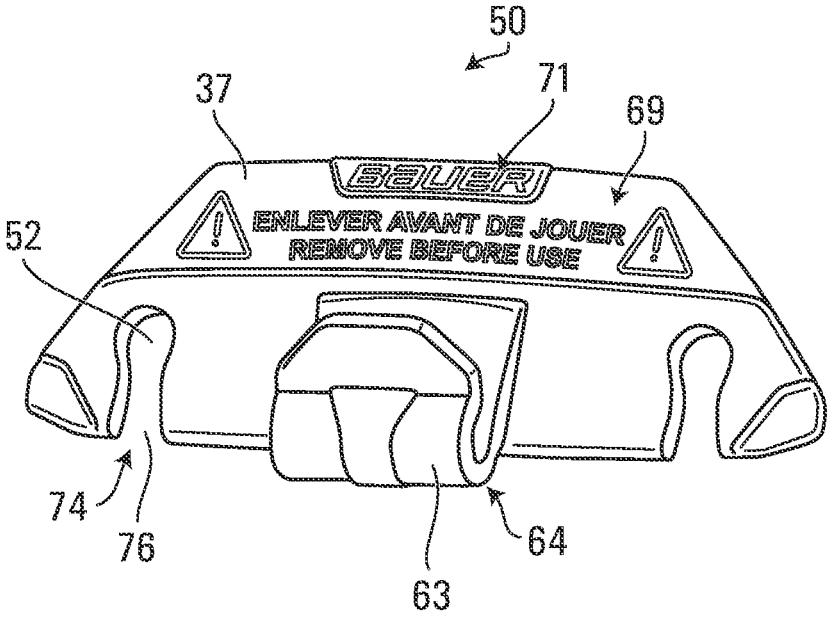
FIG. 24 is a perspective view of the clip.
Figure 31:
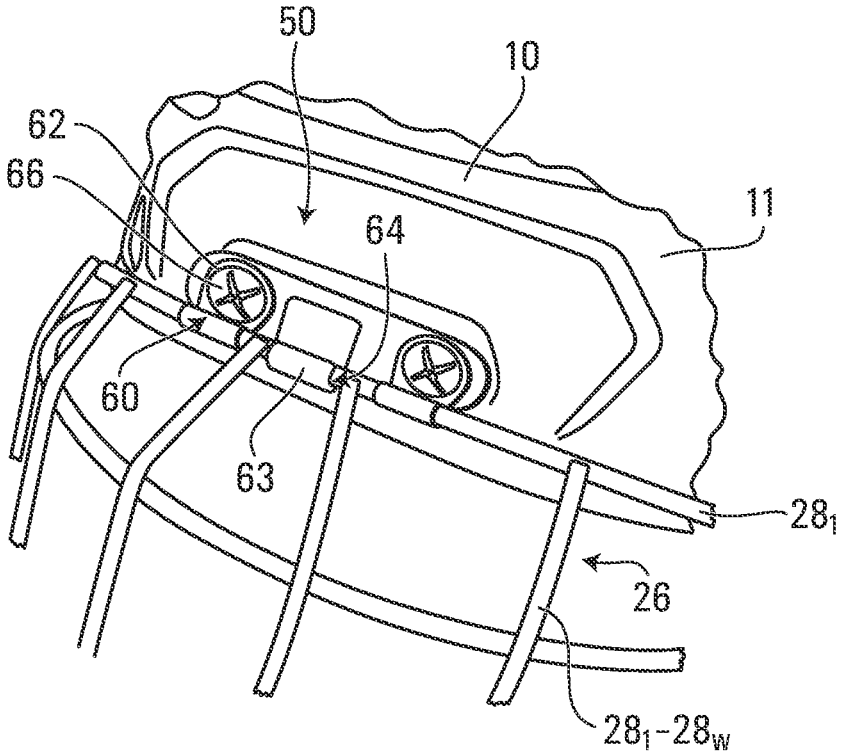
FIGS. 31 and 32 show the faceguard mounted to the clip.
Figure 32:
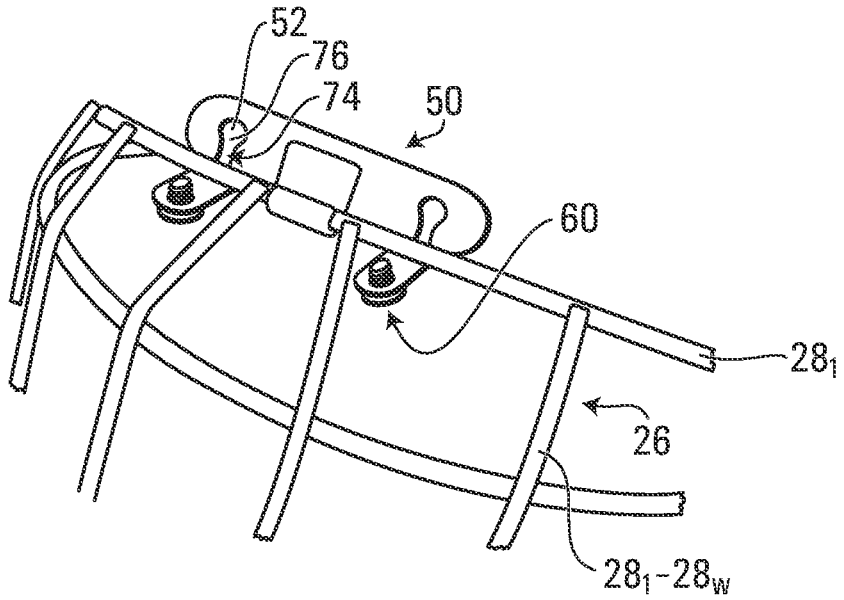

In this embodiment, as shown for instance in FIG. 24, the clip 50 comprises splits 74 contiguous to corresponding ones of the openings 52 to allow removal of the clip 50 from the helmet 10 while the fasteners 60 are fastened to the helmet 10. In this case, the splits 74 are slots 76 which are narrower than corresponding ones of the openings 52. Thus, in this case, a dimension 92 (e.g., a width) of the slots 76 may be less than a dimension 90 (e.g., a diameter) of the openings 52. This may facilitate retention of the clip 50 onto the helmet 10.

The openings 52 may be configured in any other suitable fashion.

FIG. 16 shows an exploded view of the clip 50, the faceguard 14 and the fasteners 60. In this embodiment, the fasteners 60 are threaded (i.e., each of the fasteners 60 includes a thread 80) and a diameter of the each of the openings 52 is greater than an outer diameter 96 of the thread 80 of each of the fasteners 60.

As further shown in FIG. 16, in this embodiment, the fasteners 60 are screws 66 comprising a screw head 62. In this embodiment, the screw head 62 is circular. In other embodiments, the screw head 62 may have any suitable shape (e.g., hex head).

In this case, the clip 50 may be disposed between the outer shell 11 of the helmet 10 and the screw head 62 when the clip 50 is disposed on the helmet 10.

In this case, the clip 50 is also removable from the helmet 10 by partially unscrewing the screws 66 from the helmet 10 such that the screws 66 remain partially screwed into the helmet 10 during removal of the clip 50 from the helmet 10.

In other embodiments, the fasteners 60 may comprise any other suitable fasteners (e.g., bolts, studs, rivets, etc.)

As shown in FIGS. 24 to 30, the clip 50 comprises a polymeric body 37 which defines the openings 52 and the mount 64.

As shown in FIG. 27, a portion 85 of the polymeric body 37 may be curved, for instance, to follow a contour of the helmet 10. The polymeric body 37 may have any suitable shape (e.g., square, rectangular, oblong or any other more shape such as a more complex shape).

The polymeric body 37 may have any suitable thickness. For instance, in some embodiments, a thickness 53 of the polymeric body 37 may be between 0.5 to 3.0 mm. Additionally, the thickness 53 of the polymeric body 37 may be substantially uniform or may, in other cases, be variable.

The polymeric body 37 may comprise a polymeric material. For instance, the polymeric material may include at least one of high-density polyethylene, polypropylene, or any other suitable material. A stiffness of the material may be such that the mount 64 is suitable stiff to hold the faceguard 14 in place.

Figure 23:
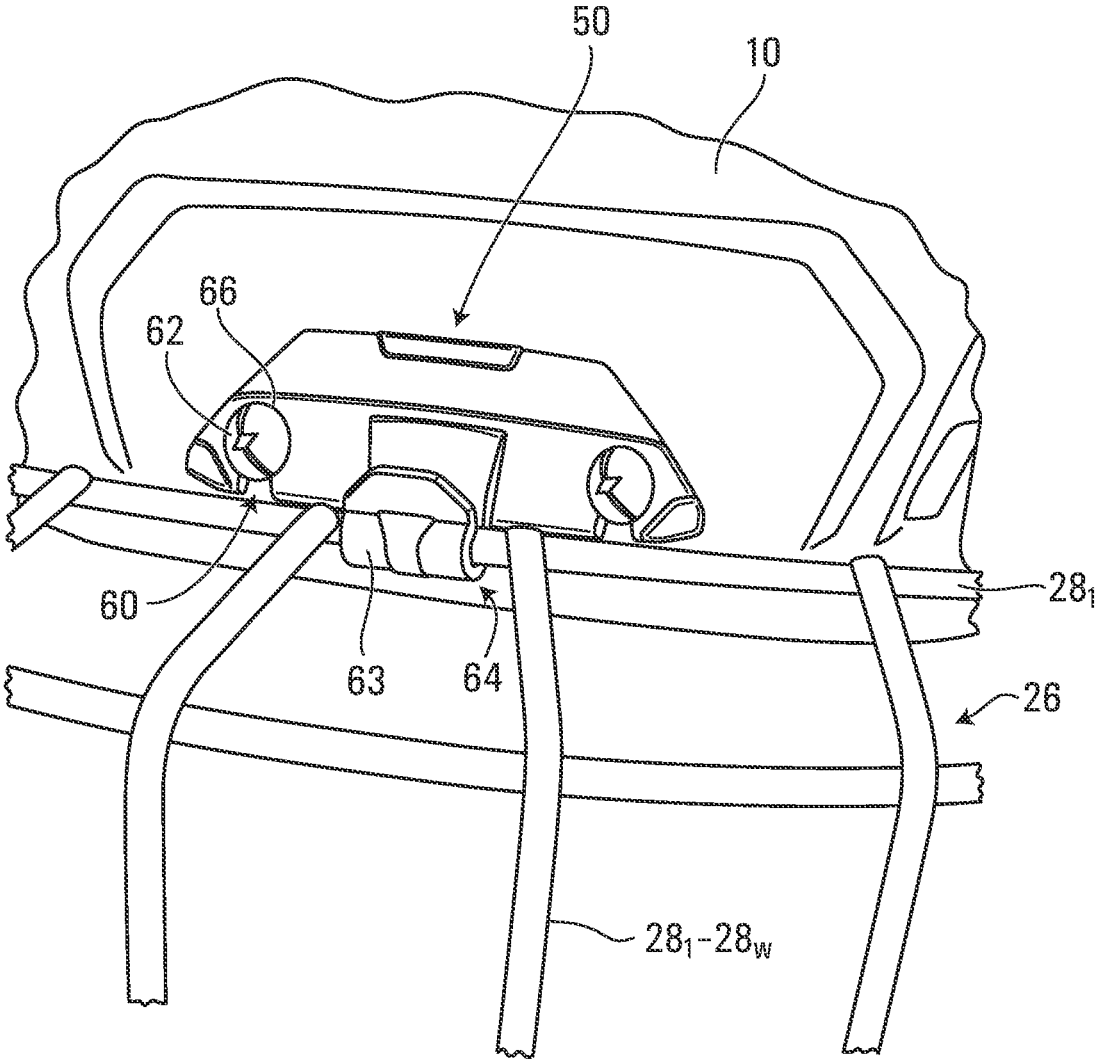
FIG. 23 shows an enlarged view of the clip and the faceguard mounted to the clip.

As shown, for instance in FIGS. 1 and 23, in this embodiment, the mount 64 comprises a hook 63 configured to mount the faceguard 14 to the clip 50 by suspending the faceguard 14 from the hook 63. As shown further shown in FIGS. 1 and 23, in this embodiment, the mount 64 is configured to engage a top horizontal wire $\mathbf{28}_1$ of the grid 26 of the faceguard 14.

Additionally, in this embodiment, the hook 63 comprises a slanted guide 65 configured to guide the faceguard 14 into the hook 63. In other embodiments, a portion of the slanted guide 65 may include a material configured to reduce friction between the faceguard 14 and the hook 63 and thus may facilitate guiding the faceguard 14 into the hook 63.

Figure 33A:
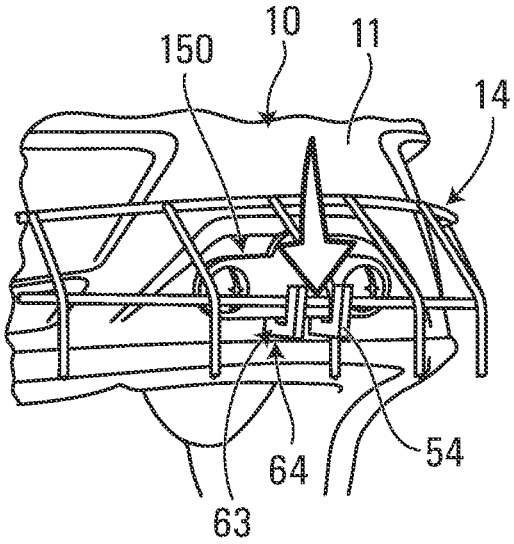
FIGS. 33A and 33B is another embodiment of the clip.
Figure 33B:
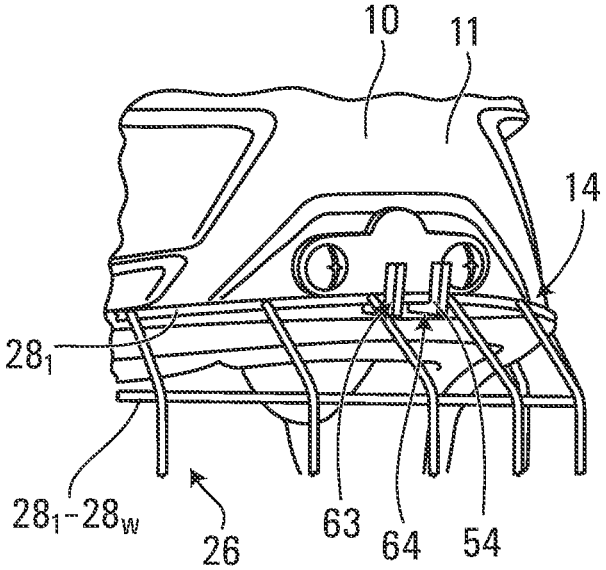

The hook 63 may be configured in any suitable fashion. For instance, as shown in the embodiment of FIGS. 33A and 33B, the clip 50, which will be designated "150", comprises the hook 63 and the hook 63 of the clip 150 may comprise a plurality of hooking portions 54. Each of the plurality of hooking portions 54 is configured to receive the top wire $\mathbf{28}_1$ of the grid 26 of the faceguard 14.

Figure 34A:
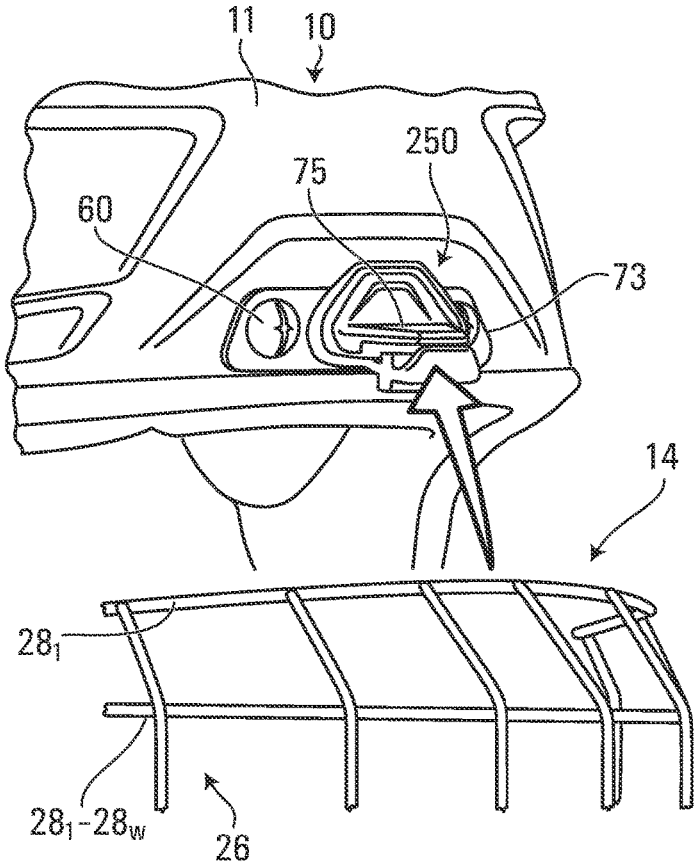
FIGS. 34A, 34B, 35A and 35B show views of another embodiment of the clip.
Figure 34B:
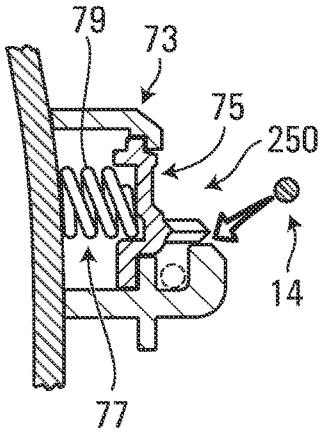
Figure 35A:
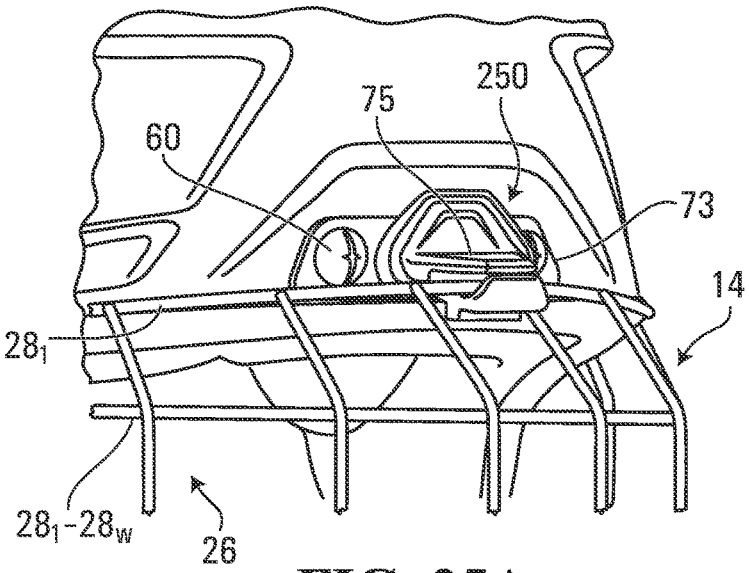
Figure 35B:
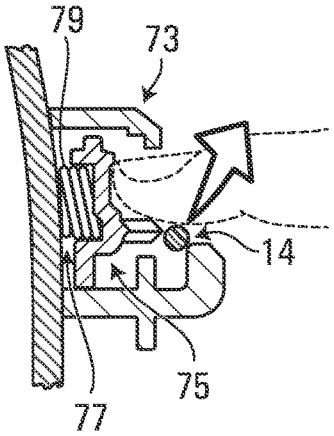

In some embodiments, the clip 50 may remain connected to the helmet 10 during use of the helmet 10 in playing hockey. For instance, as shown in FIGS. 34A, 34B, 35A and 35B, the clip 50, which will be designated "250", comprises a base 73 configured to be connected to the helmet 10 and a lock 75. In this example of implementation, the lock 75 is manually movable relative to the base 73 between an open position, as shown in FIG. 35B in which the clip 250 allows the faceguard 14 to be received by the clip 250 and removed from the clip 250 and a closed position, as shown in FIG. 34B, in which the clip 250 precludes the faceguard 14 from being received by the clip 250 and removed from the clip 250.

In this example, the lock 75 comprises a biasing mechanism 77 which includes a spring 79. In this case, the biasing mechanism 77 is configured to bias the lock 75 in the closed position.

In this embodiment, as shown in FIG. 24, the clip 50 may comprise a molded warning 69 to remove the clip 50 from the helmet 10 before use of the helmet 10 during the sport.

Additionally or alternatively, in some embodiments, the clip 50 may comprise a molded brand indicator 71 indicative of a brand of the helmet 10, as also shown in FIG. 24.

Figure 17:
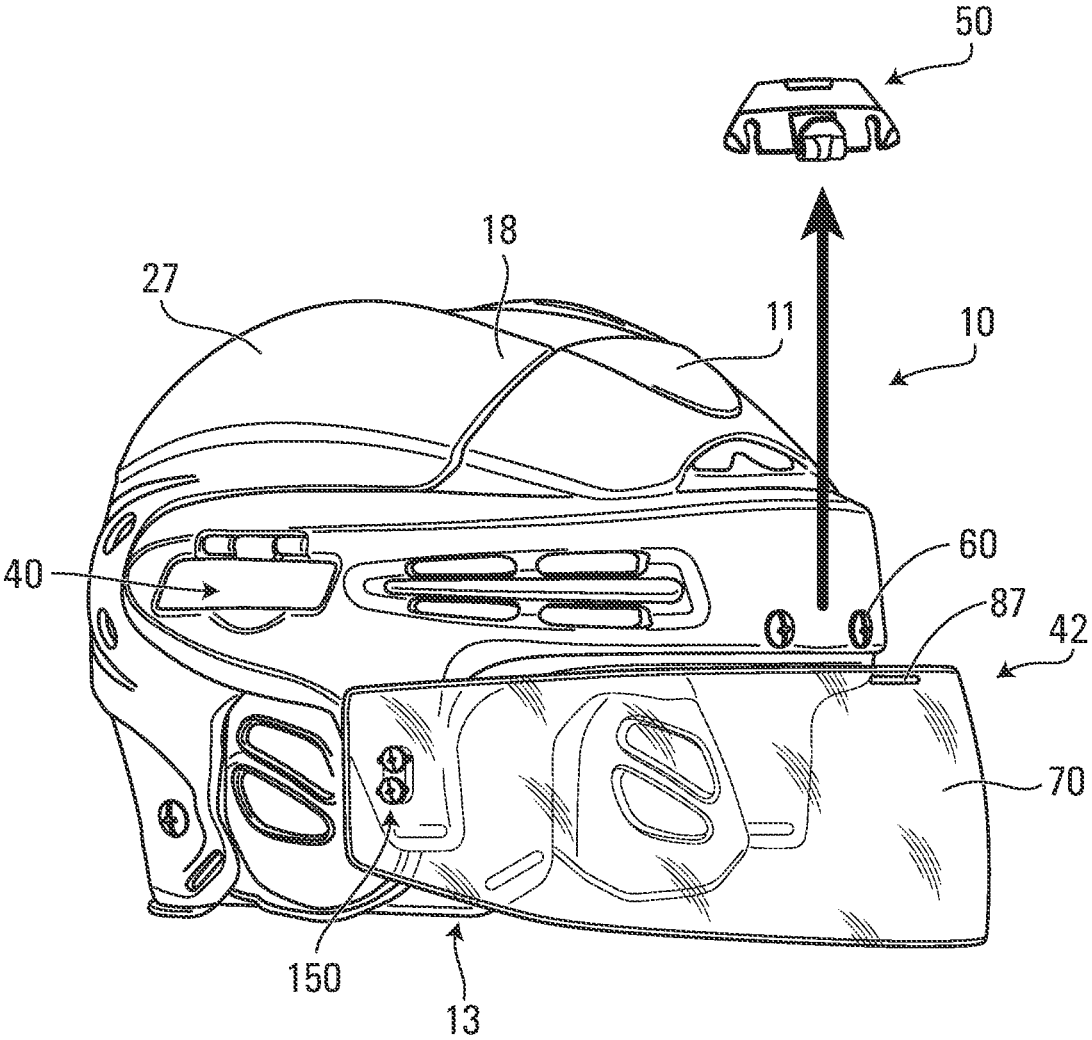
FIG. 17 shows an example of a variant of the helmet wherein the faceguard comprises a visor.

In some embodiments, as shown in FIG. 17, the faceguard 14 comprises a visor 42.

The visor 42 is transparent to allow the user to see through the visor 42 and is configured to withstand impacts during play. Thus, the visor 42 constitutes a clear shield comprising a lens 70 to protect at least part of the user's face against impacts. Although the visor 42 is transparent, at least part of the visor 42 may be tinted in some embodiments.

The visor 42 may have any suitable size. In this embodiment, the visor 42 is dimensioned to cover an eye region of the user's face to protect his/her eyes and to not cover a mouth region of the user's face. This may facilitate air circulation. The visor 42 may cover a smaller or greater extent of the user's face (e.g., all of the user's face including the mouth region) in other embodiments.

The visor 42 may comprise any suitable material. For example, in this embodiment, the visor 42 comprises polymeric material having suitable impact-resistance. More particularly, in this example of implementation, the polymeric material of the visor 42 is polycarbonate. The visor 42 may comprise any other suitable polymeric material and/or any other type of material in other examples of implementation (e.g., clear nylon, urethane-based material, polymethyl methacrylate, etc.).

As shown in FIG. 16, the mount 64 is configured to engage a recess 87 of the visor 42 of the faceguard 14.

Figure 18:
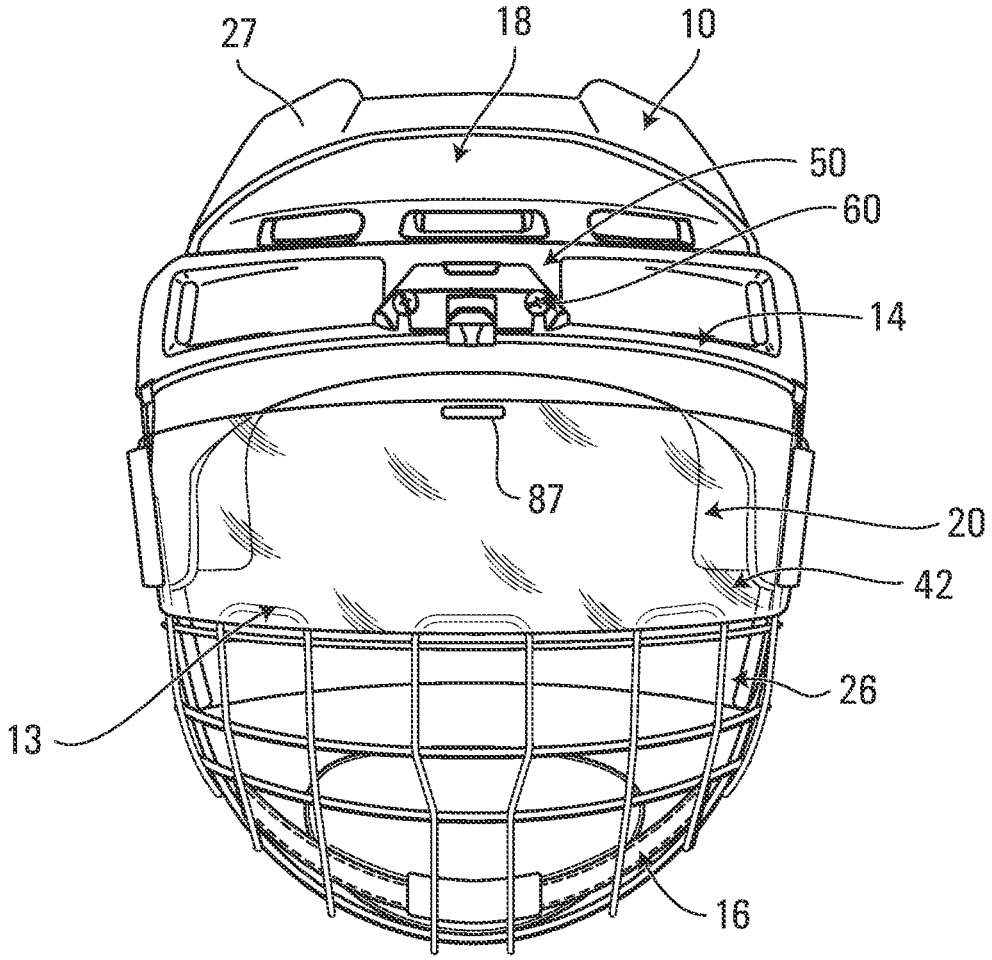
FIG. 18 shows an example of a variant of the helmet wherein the helmet comprises a visor and a grid.

In other embodiments, as shown in FIG. 18, the faceguard 14 may comprise both the grid 26 and the visor 42 (e.g., a "hybrid" faceguard).

As shown in FIG. 18, the mount 64 is configured to engage the recess 87 of the visor 42 of the faceguard 14.

An example method of facilitating mounting of the faceguard 14 to the helmet 10 will now be described. In accordance with this method, the clip 50 is connected to the helmet 50.

This may be done at a time and/or a location before the faceguard 14 is to be fastened to the helmet 10 (e.g., a retail store or other location selling or otherwise providing the helmet 10 and/or the faceguard 14). For example, this may be done by positioning the clip 50 such the respective slots 76 engage the respective fasteners 60 and by sliding the clip 50 until the respective openings 52 contiguous with the respective slots 76 abut the fastener 60. The faceguard 14 may then be mounted on the mount 64. For instance, the top horizontal wire $\mathbf{28}_1$ of the grid 26 of the faceguard 14 may be placed on the hook 63 of the mount 64. The method further includes allowing removal of the clip 50 from the helmet to fasten the faceguard 14 to the helmet 10 with the fasteners 60.

Figure 19A:
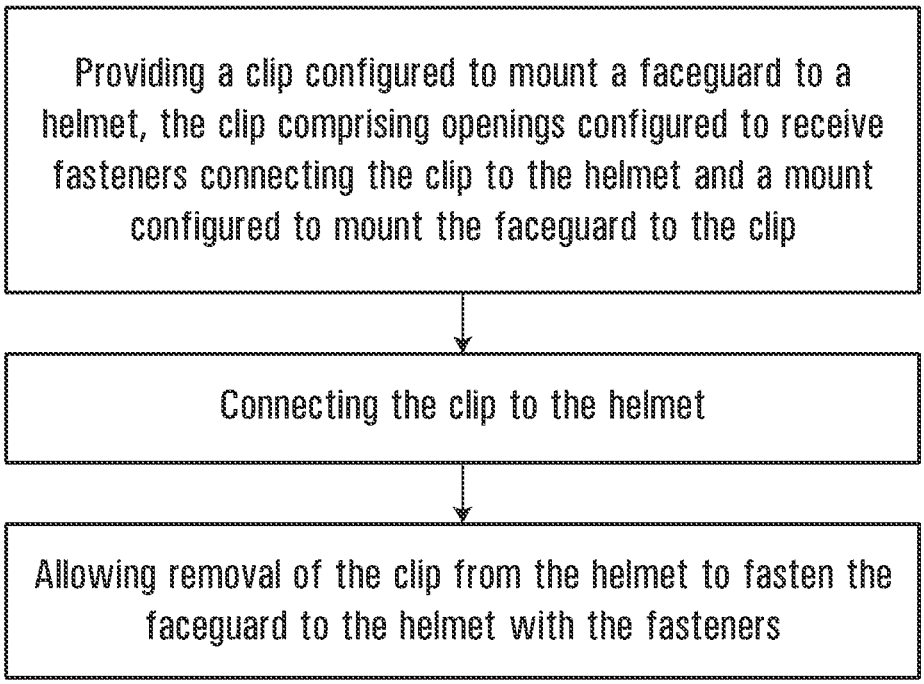
FIG. 19A shows a method of facilitating mounting of the faceguard to the helmet.

Thus, as can be appreciated, a method of facilitating mounting of a faceguard 14 to a helmet 10 has been described and is further shown in FIG. 19A. The method includes providing the clip 50 configured to mount the faceguard 14 to the helmet 10. The method also includes connecting the clip 50 to the helmet 10. The method further includes allowing removal of the clip 50 from the helmet 10 to fasten the faceguard 14 to the helmet 10 with the fasteners 60.

Figure 19B:
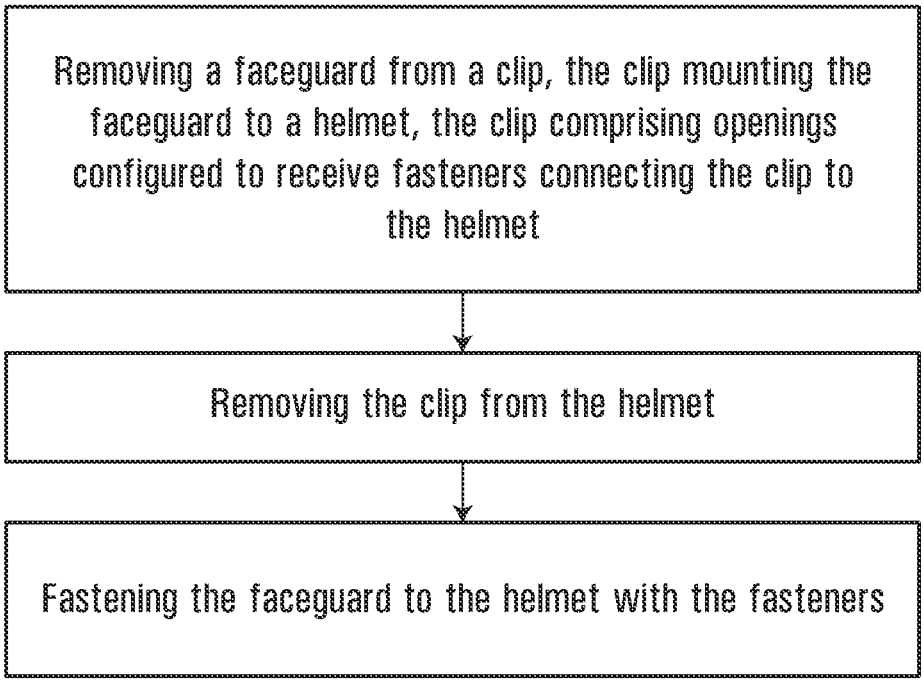
FIG. 19B shows a method of fastening the faceguard to the helmet.

A method of fastening the faceguard 14 to a helmet 10 has also been described and is further shown in FIG. 19B. In accordance with this method, the helmet 10 comprises the clip 50 configured to mount the faceguard 14 to the helmet 10. As previously discussed, the clip 50 comprises the openings 52 which are configured to receive the fasteners 60 connecting the clip 50 to the helmet 10. The faceguard 14 is removed from the clip 50 and the clip 50 is then removed from the helmet 10. The faceguard 14 may then be fastened to the helmet 10 with the fasteners 60.

Although in embodiments considered above the helmet 10 is a hockey helmet, in other embodiments, the helmet 10 may be any other helmet usable by a user playing another type of contact sport (e.g., a "full-contact" sport) in which there are significant impact forces on the user due to player-to-player and/or player-to-object contact or any other type of sports, including athletic activities other than contact sports.

In other embodiments, the helmet 10 may be a baseball/softball helmet or any other type of helmet, which may be provided with the faceguard 14.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although various embodiments and examples have been presented, this was for purposes of describing, but should not be limiting. Various modifications and enhancements will become apparent to those of ordinary skill and are within a scope of this disclosure.

The invention claimed is:

1. A clip for mounting a faceguard to a helmet, the clip comprising:

openings configured to receive fasteners connecting the clip to the helmet; and a mount including a hook configured for suspending the faceguard thereon while the clip is connected to the helmet by the fasteners, wherein the hook comprises an upwardly oriented open portion that is configured to receive a portion of the faceguard to thereby mount the faceguard to the clip;

wherein the clip is removable from the helmet to permit fastening of the faceguard to the helmet with the fasteners.

2. The clip of claim 1, wherein: the helmet comprises holes configured to receive the fasteners such that the fasteners fasten the faceguard to the helmet when the clip is removed from the helmet; and the openings of the clip are configured to be aligned with the holes of the helmet.

3. The clip of claim 1, wherein the clip is removable from the helmet while the fasteners are fastened to the helmet.

4. The clip of claim 1, wherein the clip is removable from the helmet without removing the fasteners from the helmet.

5. The clip of claim 1, wherein the clip is removable from the helmet by sliding the clip relative to the helmet and the fasteners.

6. The clip of claim 1, wherein: the fasteners are screws; and the clip is removable from the helmet by partially unscrewing the screws from the helmet such that the screws remain partially screwed into the helmet during removal of the clip from the helmet.

7. The clip of claim 1, wherein the clip is removable from the helmet by moving the clip upwardly relative to the helmet.

8. The clip of claim 1, comprising splits contiguous to corresponding ones of the openings to allow removal of the clip from the helmet while the fasteners are fastened to the helmet.

9. The clip of claim 8, wherein the splits are slots.

10. The clip of claim 9, wherein the slots are narrower than the corresponding ones of the openings.

11. The clip of claim 1, wherein: the fasteners are threaded; and each of the openings is larger than a thread diameter of each of the fasteners.

12. The clip of claim 1, wherein the hook comprises a slanted guide configured to guide the faceguard into the hook.

13. The clip of claim 1, comprising a polymeric body defining the openings and the mount.

14. The clip of claim 1, wherein the mount is configured to engage a top horizontal wire of a grid of the faceguard.

15. A clip for mounting a faceguard to a helmet, the clip comprising:

openings configured to receive fasteners connecting the clip to the helmet; and a mount including a hook configured for suspending the faceguard thereon while the clip is connected to the helmet by the fasteners, wherein the hook comprises an upwardly oriented open portion that is configured to receive a portion of the faceguard to thereby mount the faceguard to the clip;

wherein the clip is removable from the helmet while the fasteners are fastened to the helmet.

16. A helmet for protecting a user's head, the helmet comprising:

a shell;

padding disposed within the shell; and a clip for mounting a faceguard to the helmet, the clip comprising:

openings configured to receive fasteners connecting the clip to the helmet; and a mount including a hook configured for suspending the faceguard thereon while the clip is connected to the helmet by the fasteners, wherein the hook comprises an upwardly oriented open portion that is configured to receive a portion of the faceguard to thereby mount the faceguard to the clip;

wherein the clip is removable from the helmet to permit fastening of the faceguard to the helmet with the fasteners.

17. A helmet for protecting a user's head, the helmet comprising:

a shell;

padding disposed within the shell; and a clip for mounting a faceguard to the helmet, the clip comprising:

openings configured to receive fasteners connecting the clip to the helmet; and a mount including a hook configured for suspending the faceguard thereon while the clip is connected to the helmet by the fasteners, wherein the hook comprises an upwardly oriented open portion that is configured to receive a portion of the faceguard to thereby mount the faceguard to the clip;

wherein the clip is removable from the helmet while the fasteners are fastened to the helmet.

18. A method of facilitating mounting of a faceguard to a helmet, the method comprising:

providing a clip configured to mount the faceguard to the helmet, the clip comprising:

openings configured to receive fasteners connecting the clip to the helmet; and a mount including a hook configured for suspending the faceguard thereon while the clip is connected to the helmet by the fasteners, wherein the hook comprises an upwardly oriented open portion that is configured to receive a portion of the faceguard to thereby mount the faceguard to the clip;

connecting the clip to the helmet; and allowing removal of the clip from the helmet to permit fastening of the faceguard to the helmet with the fasteners.

19. The clip of claim 1, wherein the hook comprising a plurality of hooking portions.

* * * * *